US006325889B2

(12) United States Patent
Snekkenes et al.

(10) Patent No.: US 6,325,889 B2
(45) Date of Patent: Dec. 4, 2001

(54) HYDRAULIC VESSEL SYSTEM HAVING A DOWNWARDLY FEEDING SEPARATOR

(75) Inventors: Vidar Snekkenes, Karlstad (SE); Johan Engström, Esbo (FI); Sven-Erik Ohlsson, Sunne (SE); Per Nyström, Karlstad (SE); Sören Söderqvist, Karlstad (SE); Björn Karlsson, Karlstad (SE)

(73) Assignee: Kvaerner Pulping AB (SE)

( * ) Notice: Subject to any disclaimer, the term of this patent is extended or adjusted under 35 U.S.C. 154(b) by 0 days.

(21) Appl. No.: 09/737,032

(22) Filed: Dec. 14, 2000

Related U.S. Application Data

(63) Continuation of application No. 09/024,688, filed on Feb. 17, 1998, now Pat. No. 6,171,494, which is a continuation-in-part of application No. 08/908,285, filed on Aug. 7, 1997, now Pat. No. 6,123,807.

(51) Int. Cl.[7] ..... D21C 7/14; D21C 7/12

(52) U.S. Cl. ..... 162/41; 162/61; 162/251

(58) Field of Search ..... 162/18, 41, 52, 162/245, 246, 251, 61; 210/413

(56) References Cited

U.S. PATENT DOCUMENTS

| | | | | |
|---|---|---|---|---|
| 5,716,497 | * | 2/1998 | Richter et al. | 162/14 |
| 5,824,187 | * | 10/1998 | Richter et al. | 162/41 |
| 5,882,477 | * | 3/1999 | Laakso et al. | 162/63 |
| 6,024,837 | * | 2/2000 | Laakso et al. | 162/237 |
| 6,086,717 | * | 7/2000 | Snekkenes et al. | 162/245 |

* cited by examiner

*Primary Examiner*—Dean T. Nguyen
(74) *Attorney, Agent, or Firm*—Fasth Law Offices; Rolf Fasth

(57) ABSTRACT

A new and improved way of continuously cooking fiber material, wherein temperatures and alkaline levels are controlled to be maintained within specific levels in different zones of the digesting process in order to optimize chemical consumption and heat-economy and at the same time achieve very good pulp properties. The digesting process includes a top separator that separates the transport liquid from the fiber material and permits the fiber material to be exposed to the cooking liquid.

6 Claims, 15 Drawing Sheets

HYDRAULIC VESSEL SYSTEM HAVING A DOWNWARDLY FEEDING SEPARATOR

PRIOR APPLICATION

This is a continuation application of Ser. No. 09/024,688, filed Feb. 17, 1998, now U.S. Pat. No. 6,171,494 which is a continuation-in-part application of U.S. patent application Ser. No. 08/908,285, filed Aug. 7, 1997 now U.S. Pat. No. 6,123,807.

TECHNICAL FIELD

The present invention relates to a novel top separator and a method for producing pulp, preferably sulphate cellulose, with the aid of a continuous digester system.

BACKGROUND AND SUMMARY OF THE INVENTION

Environmental demands has forced our industry to develop improved cooking and bleaching methods. One recent breakthrough within the field of cooking is ITC™, which was developed in 1992–1993. ITC™ is described in WO-9411566, which shows that very good results concerning the pulp quality may be achieved. ITC™ is mainly based on using almost the same temperature (relatively low compared to prior art) in all cooking zones in combination with moderate alkaline levels. The ITC™-concept does not merely relate to the equalization of temperatures between different cooking zones, but a considerable contribution of the ITC™-concept relates to enabling an equalized alkaline profile also in the lower part of the counter-current cooking zone.

Moreover, it is known that impregnation with the aid of black liquor can improve the strength properties of the fibers in the pulp produced. The aim of the impregnation is, in the first place, to thoroughly soak each chip so that it becomes susceptible, by penetration and diffusion, to the active cooking chemicals which, in the context of sulphate cellulose, principally consist of sodium hydroxide and sodium sulphide.

If, as is customary according to prior art, a large proportion of the white liquor is supplied in connection with the impregnation, there will exist no distinct border between impregnation and cooking. This leads to difficulties in optimizing the conditions in the transfer zone between impregnation and cooking.

Now it has been found that surprisingly good results can be achieved when:

1. Keeping a low temperature but a high alkali content in the beginning of a concurrent cooking zone of the digester;

2. Withdrawing a substantial part of a highly alkaline spent liquor that has passed through at least the concurrent cooking zone; and 3. Supplying a substantial portion of the withdrawn spent liquor that has a relatively high amount of rest-alkali, to a point that is adjacent the beginning of an impregnation zone.

This leads to a reduced H-factor demand, reduced consumption of cooking chemicals and better heat-economy. Additionally, the novel method leads to production of pulp that has a high quality and a very good bleachability, which means that bleach chemicals and methods can be chosen with a wider variety than before for reaching desired quality targets (brightness, yield, tear-strength, viscosity, etc.) of the finally bleached pulp.

Furthermore, we have found that these good results can also be achieved when moving in a direction opposite the general understanding of the ITC™-teaching, in connection with digesters having a counter-current cooking zone. Instead of trying to maintain almost the same temperature levels in the different cooking zones, we have found that when using a digester that has both a concurrent and a counter-current cooking zone, big advantages may be gained if the following basic steps are used:

1. Keeping a low temperature but a high alkali content in the concurrent zone of the digester;

2. Keeping a higher temperature but a lower alkali content in the counter-current zone;

3. Withdrawing a substantial part of the highly alkaline spent liquor that has passed through at least one digesting zone; and 4. Preferably supplying almost all of the withdrawn spent liquor, that has a relatively high amount rest-alkali, to a position that is adjacent the beginning of the impregnation zone.

Also, in connection with digesters of the one-vessel type (without a separate impregnation vessel), surprisingly good results are achieved when the basic principles of the invention are used.

Moreover, preliminary results indicate that the preferred manner of using the invention may be somewhat modified also in other respects but still achieving very good result, e.g., by excluding the counter-current cooking zone. Additionally, expensive equipment might be eliminated, e.g., strainers in the impregnation vessel, hanging central pipes, etc., making installations much easier and considerably less expensive.

DETAILED DESCRIPTION

Figure 1:
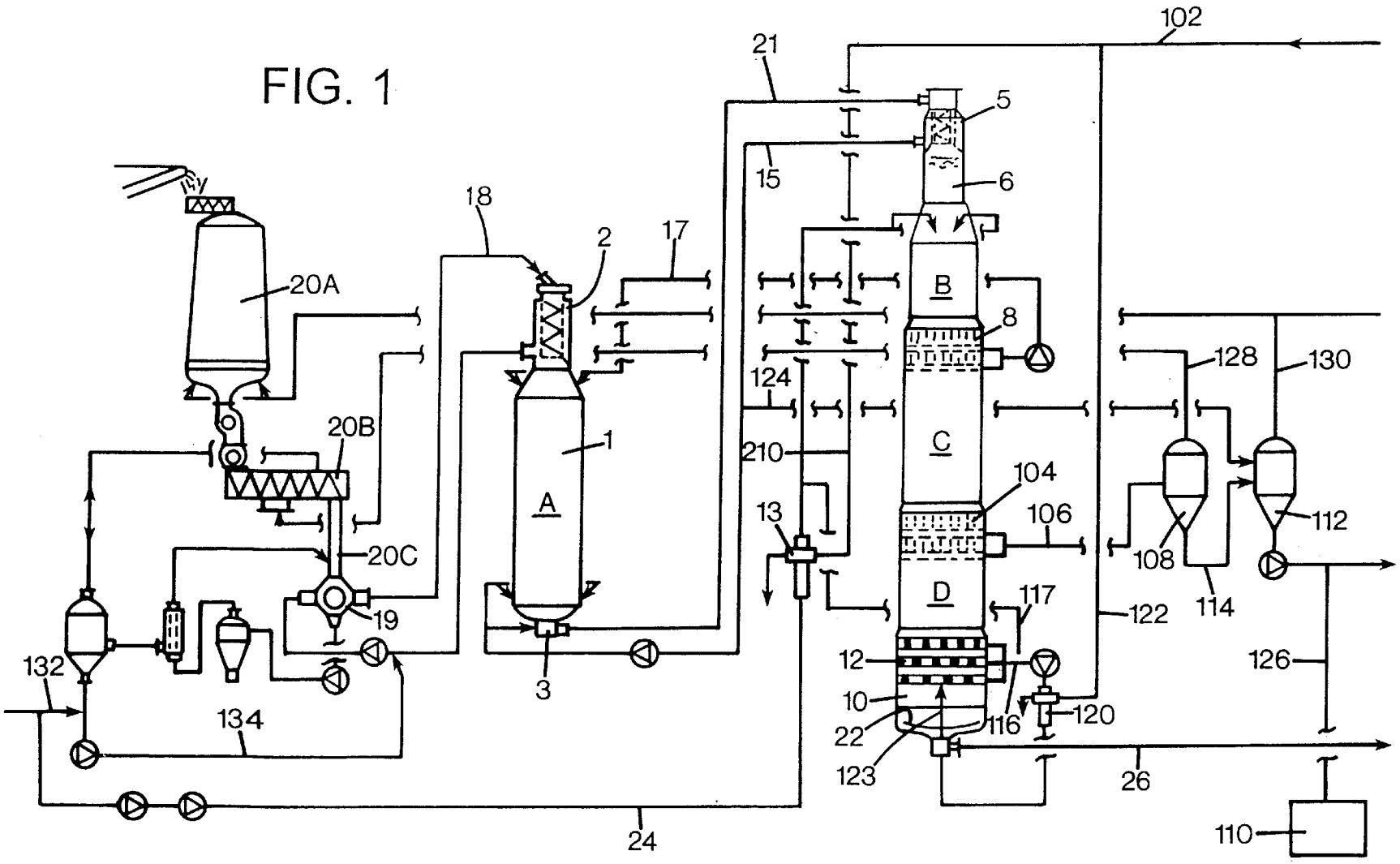
FIG. 1 is a schematic flow diagram of a preferred first embodiment of a digester system according to the present invention.

The preferred embodiments of the present invention are described with reference to FIGS. 1–14. FIG. 1 shows a preferred first embodiment of a two vessel hydraulic digester for producing chemical pulp according to the present invention. The main components of the digesting system consist of an impregnation vessel 1 and a hydraulic digester 6. It is to be understood that both the digester and the impregnation vessel may be hydraulic vessels that are totally filled with, among other things, a liquid.

The impregnation vessel 1, which normally is totally liquid filled, includes a feeding-in device 2 at the top. The feeding-in device may be of a conventional type, i.e., a top separator having a screw-feeding device that feeds the chips in a downward direction at the same time as a transport liquid is drawn off. Other types of top separators may also be used. At the bottom, the impregnation vessel 1 has a feeding-out device 3 comprising a bottom scraper. In addition to this, there is a conduit 17 that extends from the digester 6 to the impregnation vessel 1 for adding hot black liquor. As seen in FIG. 1, the black liquor is preferably supplied to the top of the impregnation vessel 1. In contrast to conventional impregnation vessels, no draw-off screen is located inside the impregnation vessel. However, such draw-off screen may be provided if desired.

The chips are fed from the chip bin 20A, through the steaming vessel 20B and the chip chute 20C. A feeding device, preferably a high-pressure feeder 19, feeds the chips suspended in a transport liquid via a conduit 18 to the top of the impregnation vessel 1. The feeder 19 is cooperating with the chute 20C, and is connected to the necessary liquid circulations and replenishment.

A conduit 21, for transporting chips and a transport liquid D, extends from the bottom of the impregnation vessel 1 up to the top 5 of the digester 6. Conduit 21 opens up at the top of a top separator 7 which feeds by means of a screw in an downwardly moving direction.

The screen of the separator may be used to draw off the transport liquid D (which is then returned in line 15) together with which the chips are transported from the impregnation vessel 1 up to the top 5 of the digester. Below the top separator 7 there are inlet openings 37 defined that are in operative engagement with a conduit 24 which (preferably via a heat-exchanger 13) leads to a cooking liquor supply such as a white-liquor container (not shown). The heat-exchanger 13 is connected to a high pressure steam conduit 102 and heats up the white liquor to a suitable temperature before the white liquor enters the top 5. As best seen in FIG. 1, approximately 95% of the total supply of the white liquor in the conduit 24 is supplied to the top 5 of the digester and the remaining 5% is supplied to the high pressure feeder 19 via a conduit 132 and a conduit 134 to lubricate the high pressure feeder 19. About 90% of the white liquor in the conduit 24 is supplied to the top of the digester, the remaining 10% is supplied to the counter-current zone D via a conduit 123.

A first screen girdle section 8 may be arranged in conjunction with a step-out approximately in the middle of the digester 6. If the digester 6 is an MCC digester, the screen section may be used to withdraw spent liquor that is conducted to a recovery unit. Draw-off from this screen girdle section 8 can also be conducted directly via the conduit 17 to the impregnation vessel 1. A second screen girdle section 104 may be arranged below the first screen girdle section 8 (in an MCC digester, the screen girdle section 104 would normally be called the MCC screen). Draw-off from the second screen section 104, such as spent liquor, i.e., black liquor, may be conducted via a conduit 106 to a first flash tank 108 to recover steam and let pressure off before the liquor is conducted to a recovery unit 110. Preferably, the spent liquor is also conducted through a second flash tank 112 via a conduit 114 to further reduce the pressure and temperature of the spent liquor before the liquor is conducted to the recovery unit 110. In the preferred embodiment, a conduit 124 conducts the spent liquor from the return conduit 15 (preferably at least 3 $m^3$/ADT) to the second flash tank 112. The spent liquor from both flash tanks 108, 112 is then conducted with a conduit 126 to the recovery unit 110. Conduits 128 and 130 may be connected to the flash tanks 108, 112, respectively, to supply steam to the chip bin 20A and the steaming vessel 20B.

At the bottom 10 of the digester, there is a feeding-out device including one scraping element 22. A third lower screen girdle section 12 is disposed at the bottom 10 of the digester 6. The girdle section 12 may, for example, include three rows of screens for withdrawing liquid, which is heated and to which some white liquor, preferably about 10% of the total amount of the white liquor in conduit 24, is added via a branch conduit 117 before it is recirculated by means of a central pipe 123, which opens up at about the same level as the lowermost strainer girdle 12.

The draw-off from the screen girdles 12 and the white liquor from the branch conduit 117 are preferably conducted via a heat exchanger 120 back to the bottom 10 of the digester 6. The temperature of this draw off is about 140° C. since it is a mix of washing liquid and black liquor. The white liquor is supplied in a counter-current direction via the central pipe 123 to the screen girdle section 12. The white liquor provides fresh alkali and, in the form of counter-current cooking, further reducing the Kappa number. A conduit 122 is connected to the high pressure steam conduit 102 to provide the heat exchanger with steam to regulate the temperature of the liquid supplied via the standpipe 123. A blow line 26 is connected to the bottom 10 of the digester for conducting the digested pulp away from the digester 6.

A preferred installation according to the present invention, as shown in FIG. 1, may function as follows. The chips are fed in a conventional manner into the chip bin 20A and are subsequently steamed in the vessel 20B and, thereafter, conveyed into the chute 20C. The high-pressure feeder 19, which is supplied with a minor amount of white liquor (approximately 5% of the total amount to lubricate the feeder), feeds the chips into the conduit 18 together with the transport liquid. The slurry of chips and transport liquid are fed to the top of the impregnation vessel 1 and may have a temperature of about 110° C. to 120° C. when entering the impregnation vessel (excluding recirculated transport liquor).

In addition to the actual fibers in the wood, the latter also conveys its own moisture (the wood moisture), which normally constitutes about 50% of the original weight, to the impregnation vessel 1. Over and above this, some condense is present from the steaming, i.e., at least a part of the steam (principally low-pressure steam) which was supplied to the steaming vessel 20B is cooled down to such a low level that it condenses and is then recovered as liquid together with the wood and the transport liquid.

Inside the top of the impregnation vessel 1, the screw feeder 2 pushes the chips in a downward direction. No liquid is necessarily recirculated within the impregnation vessel 1. Instead, spent liquor, such as black liquor, from the screen girdle section 8 is preferably supplied to the impregnation vessel 1. However, it is to be understood that liquid may be recirculated within the impregnation vessel 1.

The chips which are fed out from the bottom of the top screen 2 of the impregnation vessel 1 then move slowly downwards in a plug flow through the impregnation vessel 1 in a liquid/wood ratio between 2/1–10/1 preferably between 3/1–8/1, more preferred of about 4/1–6/1. Hot black liquor, which is drawn off from the screen girdle section 8, may be added, via the conduit 17, to the top of the impregnation vessel 1. The black liquor may also be added to other sections of the impregnation vessel such as to an intermediate section of the impregnation vessel. The high temperature of the black liquor (100° C. to 160° C.), preferably exceeding 130° C., more preferred between 130° C. to 160° C., ensures rapid heating of the chips flowing through the impregnation vessel 1. In addition, the relatively high pH, exceeding pH 10, of the black liquor neutralizes acidic groups in the wood and also any acidic condensate accompanying the chips, thereby, i.e., counteracting the formation of encrustation, so-called scaling.

An additional advantage of the method of the present invention is that the black liquor supplied into the impregnation vessel 1 has a high content of rest alkali, (effective alkali EA as NaOH), at least 13 g/l, preferably about or above 16 g/l and more preferred between 13–30 g/l at the top of the impregnation vessel 1. This alkali mainly comes from the black liquor due to the high amount of alkali in the concurrent zone B of the digester 6. Furthermore, the strength properties of the fibers are positively affected by the impregnation because of the high amount of sulphide. A major portion of the black liquor may be directly (or via one flash) fed into the impregnation vessel 1. A minor amount of the black liquor may be used for transferring the chips from the high pressure feeder 19 to the inlet of the impregnation vessel 1.

The minor flow of the black liquor should be cooled (not shown) before it is entered into the feeder 19. The two flows of black liquor are preferably used to regulate the temperature within an impregnation zone A disposed inside the impregnation vessel 1. In the preferred embodiment, the temperature should not exceed 140° C. However, it should be understood that the temperature may exceed 140° C. The total supply of black liquor to the impregnation vessel 1 may exceed 80% of the amount drawn off from the draw-off strainers 8, preferably more than 90% and most preferred about 100% of the total flow, which normally is about 8–12 $m^3$/ADT.

The retention time in the impregnation zone A should be at least 20 minutes, preferably at least 30 minutes and more preferred at least 40 minutes. However, a shorter retention time than 20 minutes, such as 15–20 minutes may also be used. The volume of the impregnation vessel 1 may be larger than 1/11, preferably larger than 1/10 of the volume of the digester 6. Additionally, in the preferred embodiment, the volume V of the impregnation vessel 1 should exceed 5 times the value of the square of the maximum digester diameter, i.e., $V=5D^2$, where D is the maximum diameter of the digester 6.

From tests made in lab-scale, we have found indications that it is desirable to keep the alkaline level at above at least 2 g/l, preferably above 4 g/l, in the impregnation vessel 1 in connection with black liquor, which would normally correspond to a pH of about 11. If not, it appears that dissolved lignin precipitates and even condenses.

The chips, which have been thoroughly impregnated and partially delignified in the impregnation vessel 1, may be fed to the top of the digester 6 and conveyed into the downwardly-feeding top separator 7. The chips are thus fed downwards through the screen, meanwhile free transport liquid may be withdrawn outwardly through the separator screen. Before the chips enter the concurrent cooking zone B, the chips pieces are drained with cooking liquor, such as white liquor, which is supplied by means of the annular openings 37 at the top separator 7 (see FIG. 2).

The quantity of white liquor that is added at the top separator 7 depends on how much white liquor possibly is added else where, but the total amount corresponds to the quantity of white liquor that is required to achieve the desired delignification of the wood chips. Preferably, a major part of the white liquor is added here, i.e., more than 60%, which also improves the diffusion velocity, since it increases in relation to the concentration difference (chip-surrounding liquid). The thoroughly impregnated chips very rapidly assimilate the active cooking chemicals by diffusion, since the concentration of alkali (EA as NaOH) is relatively high, at least 20 g/l, preferably between 30 g/l and 50 g/l and more preferred about 40 g/l.

The chips then move down in the concurrent zones B, C through the digester 6 at a relatively low cooking temperature, i.e., between 130° C. to 160° C., preferably about 140° C. to 150° C. The major part of the delignification takes place in the first and second concurrent cooking zones B, C.

The liquid-wood ratio should be at least 2/1 and should be below 7/1, preferably in the range of 3/1–5.5/1, more preferred between 3.5/1 and 5/1. (The liquid wood-ratio in the counter-current cooking zone should be about the same as in the concurrent cooking zones.)

The temperature in a lower counter-current zone D is preferably higher than in the concurrent zones B, C, i.e., preferably exceeding 140° C., preferably about 145° C. to 165° C., in order to dissolve remaining lignin. The alkali content in the lowermost part of the concurrent cooking zone C should preferably be lower than in the beginning of the concurrent zone B, above 5 g/l, but below 40 g/l. Preferably less than 30 g/l and more preferred between 10–20 g/l. Expediently, the conduit 116 may be charged with about 5–20%, preferably 10–15%, white liquor from the conduit 24 via the conduit 117. Below the draw-off screen section 104 is the counter-current zone D that is defined between the section 104 and the section 12.

The temperature of the liquid which is recirculated via the pipe 123 up to the screen girdle section 12 is regulated with the aid of the heat exchanger 120 so that the desired cooking temperature is obtained at the lowermost part of the counter-current cooking zone D.

At the lowermost part of the digester, cool wash liquid is added in order to displace, in counter-current, hot liquid which is subsequently withdrawn at the lowermost screen girdle 12.

Figure 2:
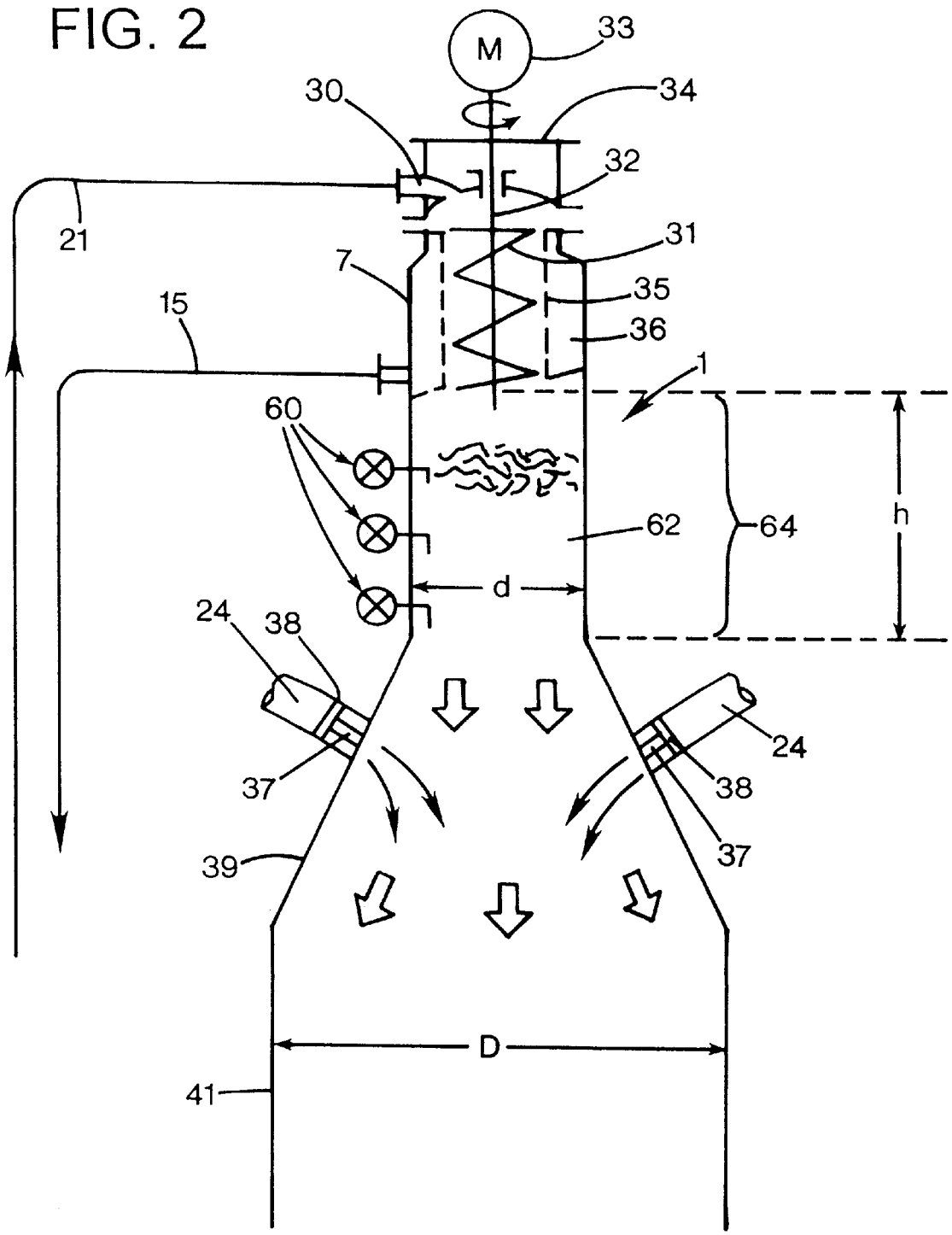
FIG. 2 is a cross-sectional view of a preferred first embodiment of a top separator to be used in an impregnation vessel or a single vessel digester according to the present invention.

FIG. 2 shows a preferred embodiment of a separator that may be used together with an impregnation vessel that is part of a digester system, such as the digester system shown in FIG. 1, where there is a need for a heat seal. The advantage of providing the heat seal in the separator is to enable the injection of hot black liquor into the separator without risking to operate the high pressure feeder at too high of a temperature. The heat seal reduces or even eliminates the risk of any hot liquor being inadvertently conducted back to the high pressure feeder which may damage the feeder. It is to be understood that the separator may also be used in an impregnation vessel that is connected to a steam/vapor phase digester and the separator may be used in a single-vessel hydraulic digester.

Only a portion of a an impregnation vessel 1 is shown. The non-impregnated slurred fiber material is transferred to the top of the digester by means of the transfer line 21 and enters an in-let space 30 of a screw-feeder 31. The screw-feeder 31 is attached to a shaft 32 connected to a drive-unit 33 which is attached to a mounting-plate 34 at the top of the digester shell 6. The drive-shaft 32 is rotated in a direction so as to force the screw to feed the chips and the transport fluid in a downward direction.

A cylindrical screen-basket 35 surrounds the screw-feeder 31. The screen-basket 35 is arranged within the digester shell 6 so as to define a liquid collecting space 36 between the digester shell and the outer surface of the screen-basket 35. The liquid collecting space 36, which preferably is annular, communicates with a conduit 15 for withdrawing liquid from the liquid collecting space 36, which in turn is replenished by liquid from the slurry within the screen basket 35. The major part of the free liquid within the slurry entering the screen basket is withdrawn into the liquid collecting space 36, but a small portion of free liquid, at least about 0.5 $m^3$/ADT should not be withdrawn from the slurry.

A set of level sensors 60 are positioned along a side wall of the digester 6 to sense the level in the digester. The level sensors are disposed below the screw-feeder 31 but above the pair of liquid supply devices 37. A top section 62 of the digester 6 has a diameter (d) that is less than a diameter (D) of the digester at a mid-portion and bottom portion thereof. The diameter (d) is small to reduce or even avoid any substantial heat transfer to the T-C lines so that the T-C lines may maintain a temperature that is slightly above 100° C. In this way, a heat lock zone 64 is formed between the liquid supply devices 37 and the top of the level sensors 60. Preferably, the heat lock zone 64 has a length h that is greater than the diameter d where h is the distance between the lower edge of the screen 35 and the transition zone and d is the diameter of the separator at its upper end, as described earlier. It is to be understood that the heat lock zone may have any other suitable length.

The liquid supply device 37 preferably comprises an annular distribution ring 38 which has a number of supply conduits 37 disposed between the ring and the impregnation vessel 1. The supply conduits 37 open up into the chips pile for supply of liquid into the fiber material moving down into the impregnation vessel 1. The annular distribution ring 38 is replenished by means of the conduit 24 wherein a desired amount of liquid is supplied. The liquid supplied through the liquid supply device 37 and ring 38 may be hot black liquor having a relatively high amount of effective alkaline, in order to provide for the possibility of establishing a concurrent impregnation zone (B) having a desired temperature of about 120° C. to 145° C., and a desired content of effective alkaline, of about 10–20 g/l.

Figure 2A:
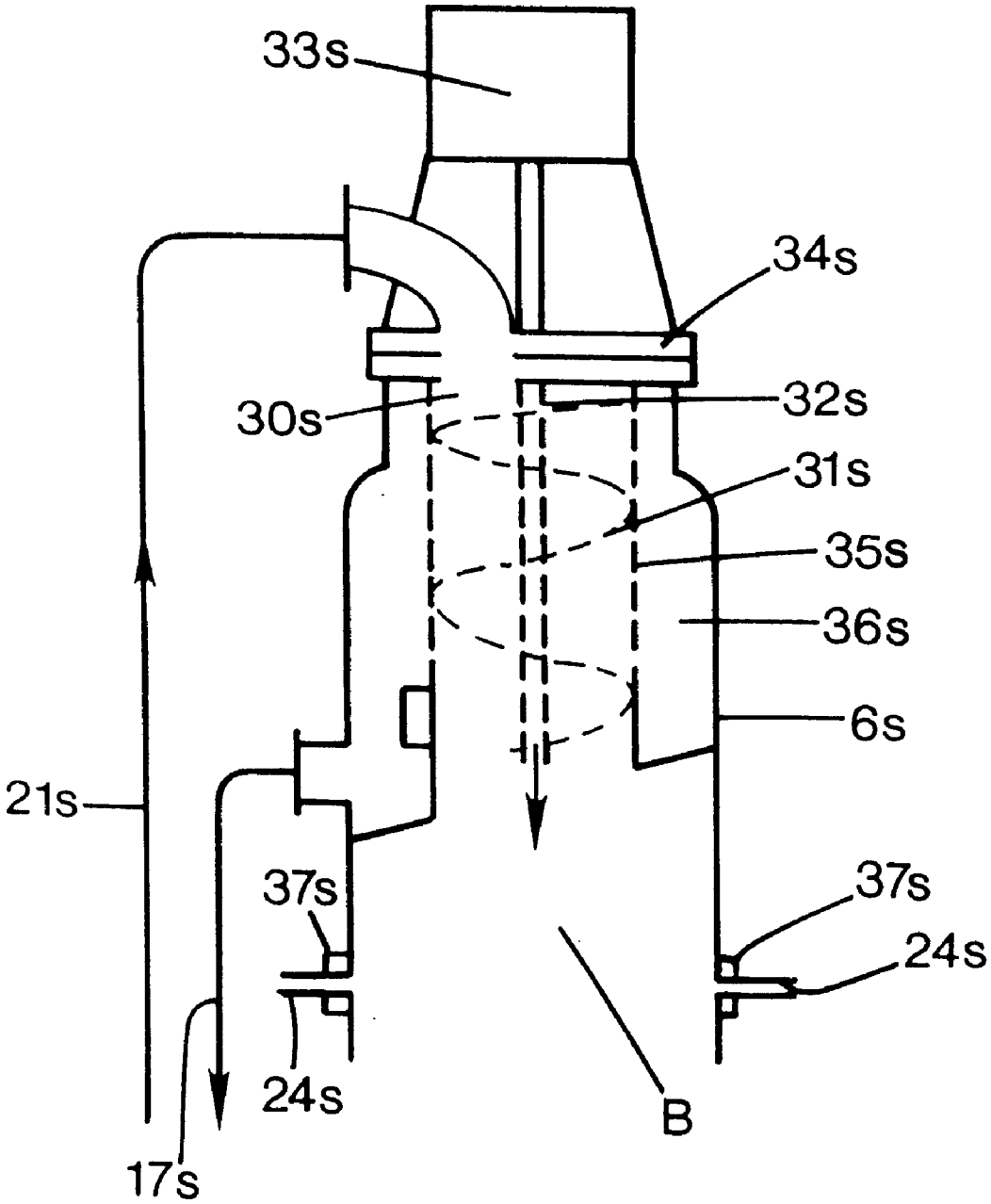
FIG. 2A is a cross-sectional view of a preferred second embodiment of a top separator to be used in a digester according to the present invention.

In FIG. 2A, there is shown a simpler separation device intended for a two-vessel hydraulic digester. If the separator shown in FIG. 2A is used in an impregnation vessel (that is part of a two vessel steam/vapor phase digester system) the separator works exactly in the same way. The heat-seal eliminates any risk of obtaining any hot return-liquid in return line 15 which could cause problems with the operation of the high pressure feeder. Only a part of the top of the digester 6*s* is shown. The slurred fiber material is transferred to the top of the digester by means of a transfer line 21*s* and enters an in-let space 30*s* of a screw-feeder 31*s*. The screw-feeder 31*s* is attached to a shaft 32*s* connected to a drive-unit 33*s* which is attached to a mounting-plate 34*s* on the top of the digester shell 6*s*. The drive-shaft 32*s* is rotated in a direction so as to force the screw to feed in a down-ward direction.

A cylindrical screen-basket 35*s* surrounds the screw-feeder 31*s*. The screen-basket 35*s* is arranged within the digester shell 6*s* so as to form a liquid collecting space 36*s* between the digester shell and the outer surface of the screen-basket 35*s*. The liquid collecting space 36*s*, which preferably is annular, communicates with a conduit 15*s* for withdrawing liquid from the liquid collecting space 36*s*, which in turn is replenished by liquid from the slurry within the screen basket 35*s*. The major part of the free liquid within the slurry entering the screen basket is withdrawn into the liquid collecting space 36*s*, but a small portion of free liquid, at least about 0.5 $m^3$/ADT should not be withdrawn from the slurry.

Below the outlet end of the screen basket 35*s* there is arranged a pair of liquid supply devices 37*s*, each preferably comprising an annular distribution ring which opens up into the chips pile for supply of liquid into the fiber material moving down into the digester 6*s*. The liquid supply devices 37*s* are replenished by means of lines 24*s* wherein a desired amount of liquid is supplied. If it is a two-vessel hydraulic digester system, the liquid supplied through the liquid supply devices 37*s* would be hot cooking liquor having a relatively high amount of effective alkaline, in order to provide for the possibility of establishing a concurrent cooking zone (B) having a desired temperature of about 145–150° C., and a desired content of effective alkaline, e.g. about 45 g/l.

A major advantage with both kinds of the shown separation devices is that they provide for establishing a distinguished change of zones (they enable almost a total exchange of free liquid at this point), which means that the desired conditions in the beginning of the concurrent zone (B) can easily be established.

Figure 3:
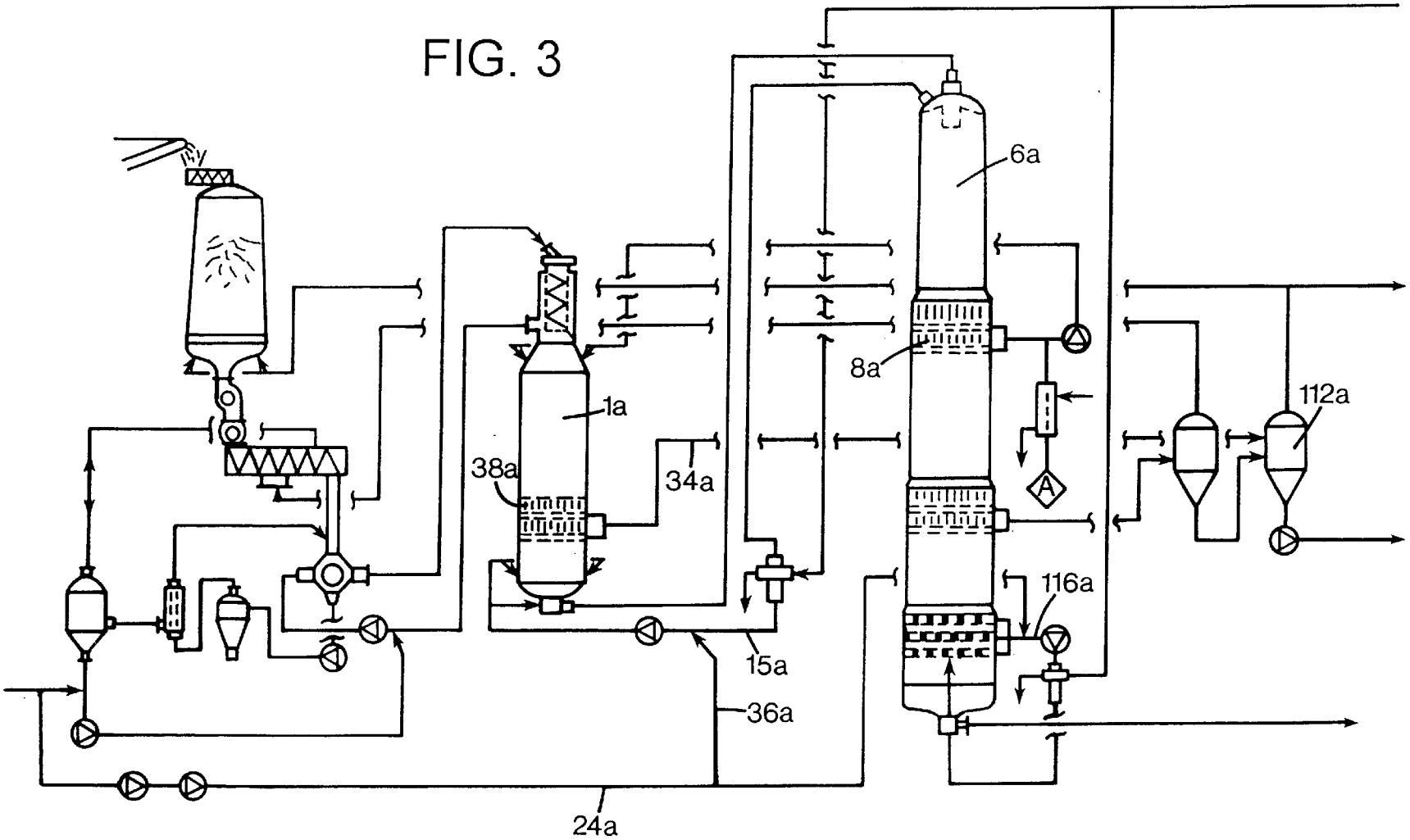
FIG. 3 is a schematic flow diagram of a preferred second embodiment of a digester system according to the present invention.

FIG. 3 illustrates an second embodiment of the hydraulic digester system of the present invention. This embodiment is almost identical to the embodiment shown in FIG. 1. Only the main differences are therefore described. It relates to a two-vessel hydraulic digester which, accordingly, has a downwardly feeding separator at the top of the digester. A screen girdle section 38*a* is disposed at the bottom of an impregnation vessel 1*a*. Spent liquor is withdrawn at the girdle section 38*a* and conducted via a conduit 34*a* to a second flash tank 112*a* to be further conducted to a recovery unit, as described in FIG. 1. A conduit 36*a* extends between a return conduit 15*a* and a conduit 24*a* so that a portion of the white liquor in the conduit 24*a* is conducted via the conduit 36*a* to the return line 15*a*. Instead of conducting the white liquor in the conduit 24*a* up to the top of a digester 6*a*, the conduit 24*a* is connected to the conduit 116*a* so that about 90% of the white liquor in the conduit 24*a* is conducted to the conduit 116*a*. The remaining parts of this embodiment operates in a way that is very similar to the embodiment described in FIG. 1.

Figure 4:
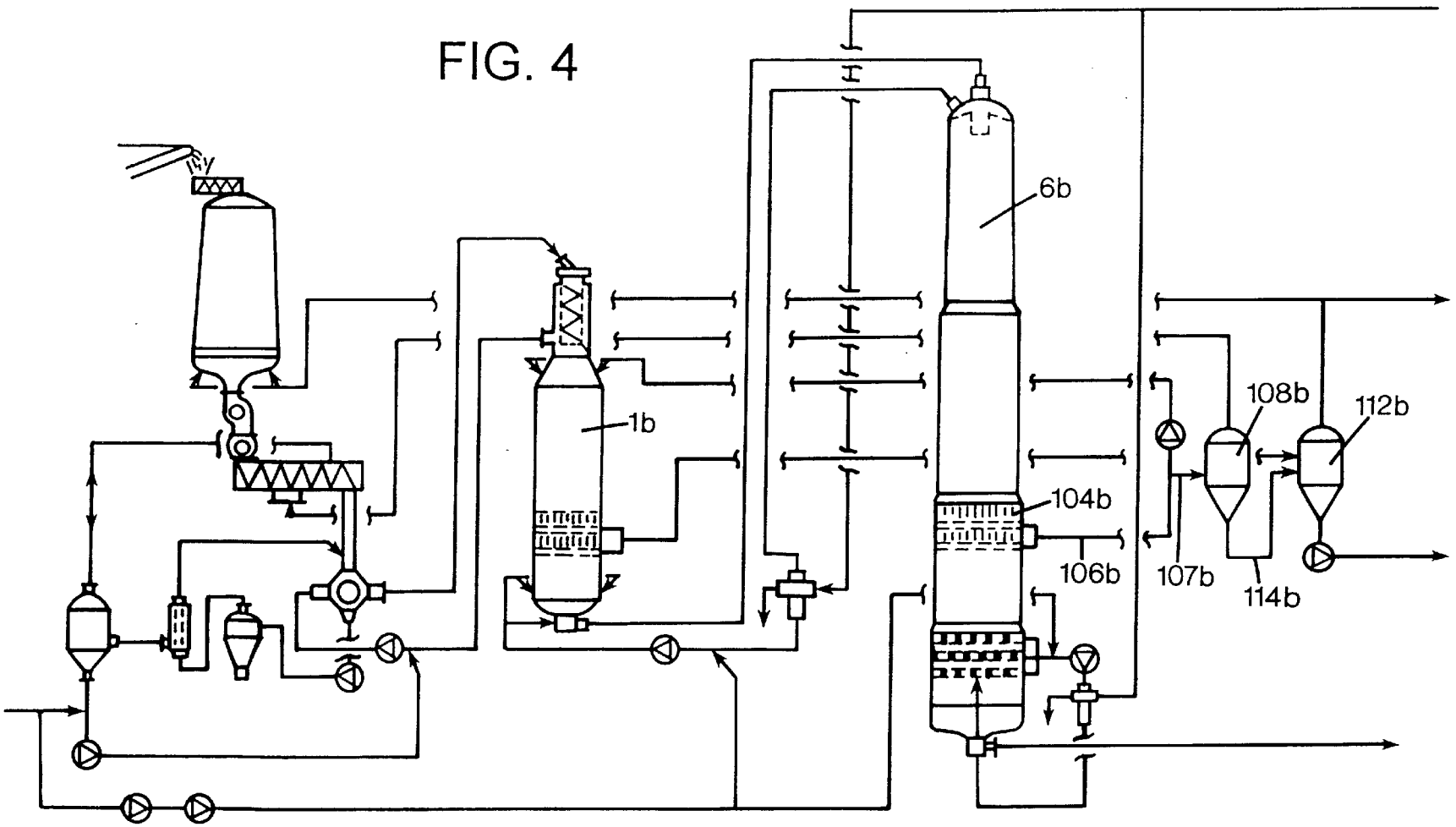
FIG. 4 is a schematic flow diagram of a preferred third embodiment of a digester system according to the present invention.

FIG. 4 also shows a hydraulic digester, being the third embodiment of the present invention. Only the new features of this embodiment compared to the first embodiment are described. A conduit 106*b* attached to a digester 6*b* conducts spent liquor that has been withdrawn from a screen section 104*b* to the top of an impregnation vessel 1*b*. A portion of the spent liquor withdrawn in the conduit 106*b* is diverted via a conduit 107*b* to a first flash tank 108*b* and then via a conduit 114*b* to a second flash tank 112*b*. It should be noted that the third embodiment does not have a screen girdle section at the upper end of the digester 6*b*.

Figure 5:
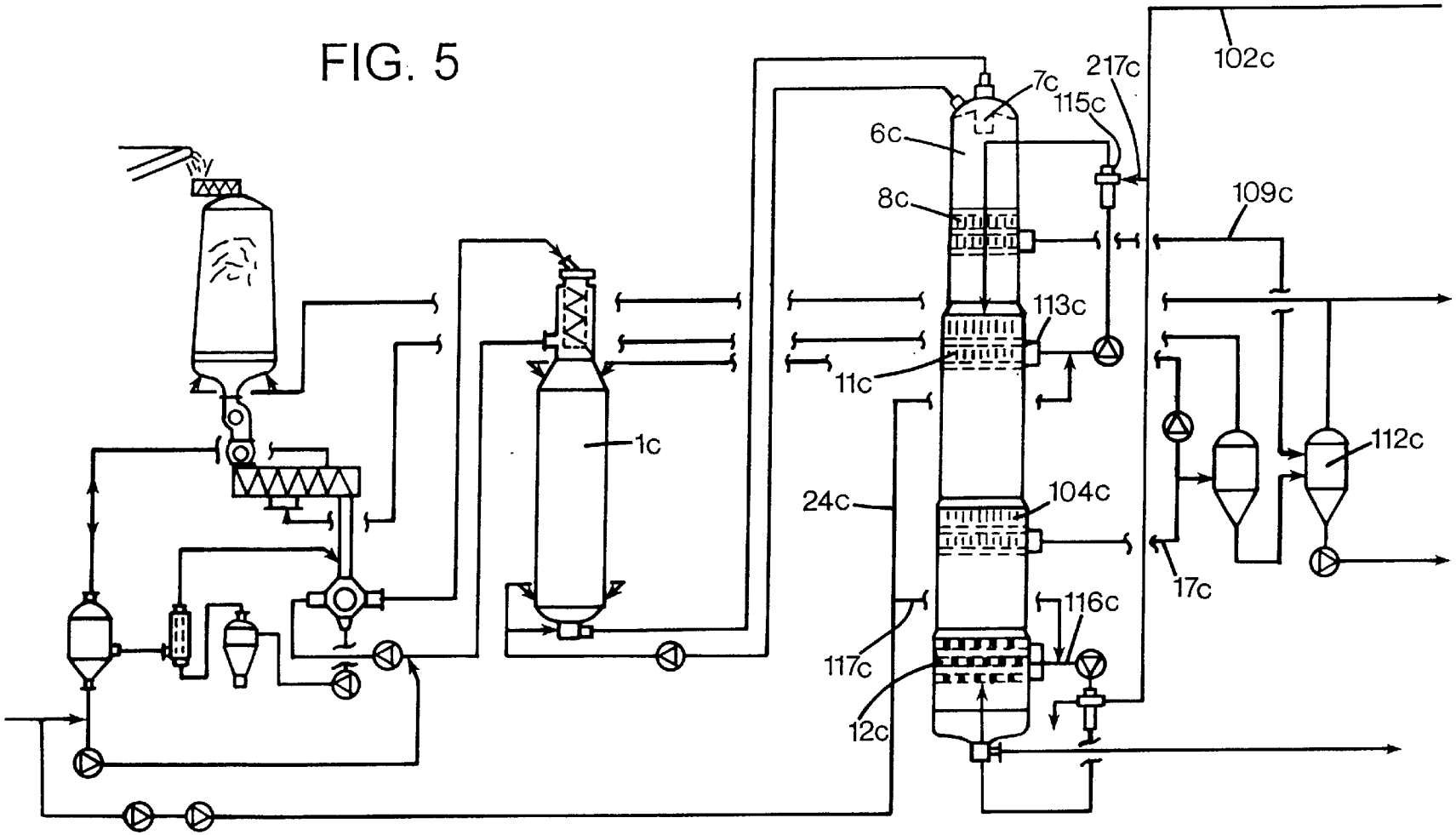
FIG. 5 is a schematic flow diagram of a preferred fourth embodiment of a digester system according to the present invention.

FIG. 5 describes a fourth embodiment of the present invention. A digester 6*c* has a first screen girdle section 8*c* disposed therein. Spent liquor is withdrawn from the girdle section 8*c* via a conduit 109*c* to a second flash tank 112*c*. The spent liquor withdrawn from the girdle section 8*c* has a low effective alkali value that is below 12 g/l.

The digester 6*c* also has a second screen girdle section 11*c* immediately below the first screen girdle section 208*d*. Liquor is withdrawn from the second screen girdle section via a conduit 113*c*. A conduit 24*c* conducts white liquor so that approximately 5% to 15% of the white liquor in the conduit 24*c* is diverted via a conduit 117*c* to a conduit 116*c* that is connected to a lower screen girdle section 12*c*. The remaining amount of white liquor in the conduit 24*c* is conducted up to the conduit 113*c*. The liquor withdrawn from the screen girdle section 11*c* together with the white liquor from the conduit 24*c* is via a central pipe conducted back into the digester at about the same level as the screen girdle section 8*c*. With this embodiment, the impregnation zone is prolonged to also include the upper zone of the digester, i.e., to the screen 8*c*. Below the screen 8*c*, the cooking zone commences at the point there the conduit 113*c* opens up. The cooling liquor is then radially, uniformly displaced/mixed into the chips column by means of withdrawing and recirculating liquor with the screen 11*c*.

In the preferred fourth embodiment, the conduit 113*c* is associated with a heat exchanger 115*c* to regulate the temperature of the black liquor and the white liquor which is to be reintroduced by the conduit 113*c*. The heat exchanger is adapted to receive steam via a conduit 217*c* that is connected to a main high pressure steam conduit 102*c*. Similar to the embodiment shown in FIG. 1, spent liquor is also withdrawn from a screen girdle section 104*c* and conducted back to an impregnation vessel 1*c* via a conduit 17*c*. The effective alkali of the spent liquor that is conducted in the conduit 17*c* is about 13 g/l.

Figure 6:
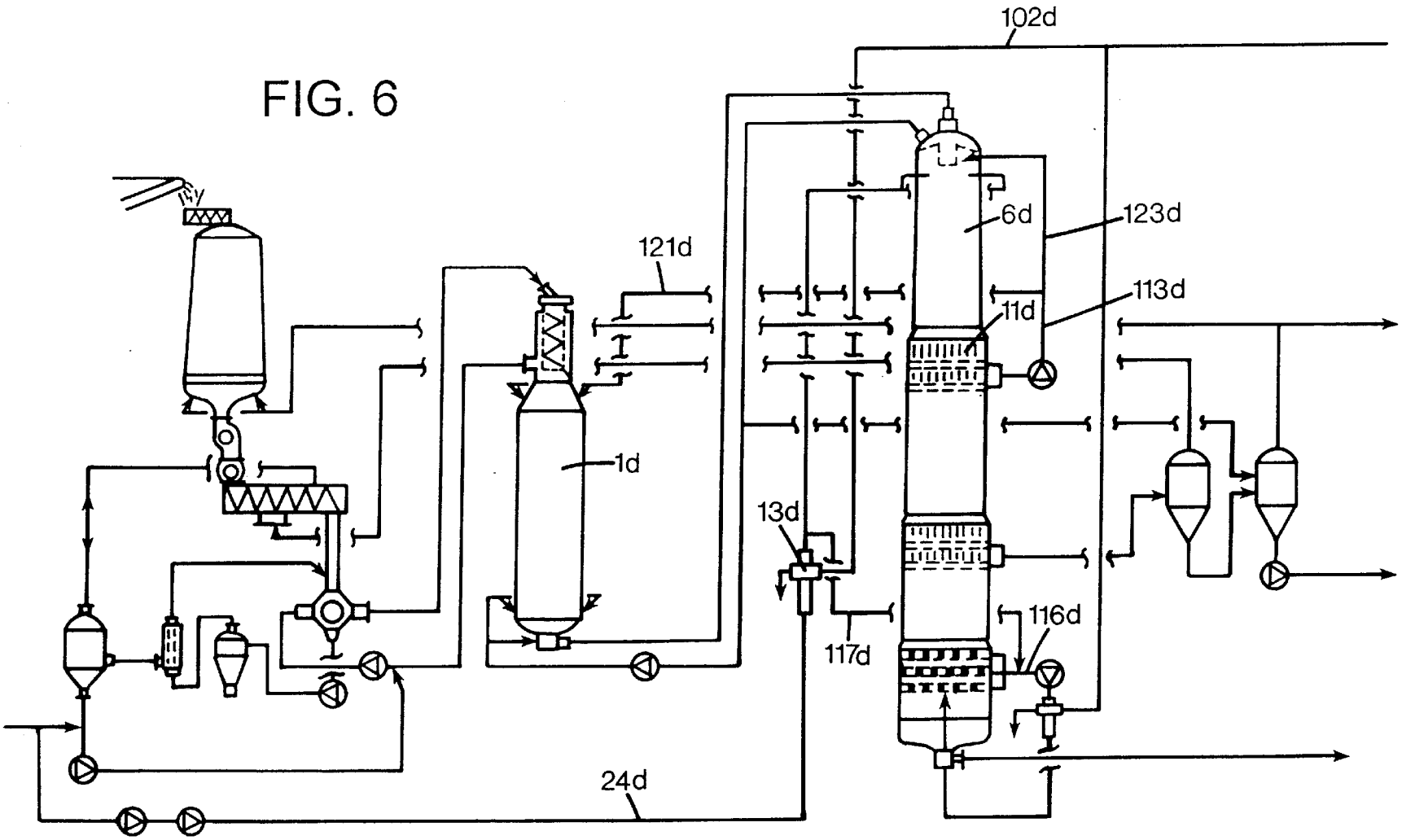
FIG. 6 is a schematic flow diagram of a preferred fifth embodiment of a digester system according to the present invention.

FIG. 6 illustrates an fifth embodiment of the present invention. White liquor is supplied to a digester 6*d* via a conduit 24*d*. The temperature of the white liquor may be regulated by a heat exchanger 13*d* that is adapted to receive steam from a high pressure steam conduit 102*d*. About 5% to 15% of the total amounts of the white liquor in the conduit 24*d* is diverted via a conduit 117*d* to a conduit 116*d*. The remaining portion is conducted up to a top portion of the digester 6*d*. Spent liquor may be withdrawn from a screen girdle section 11*d* via a conduit 113*d*. A major portion of the spent liquor in the conduit 113*d* is diverted and conducted via a conduit 121*d* back to an impregnation vessel 1*d*. The addition of a small amount of black liquor to the top of the digester 6*d* prevents the white liquor from flowing back into the separator. Accordingly, the black liquor addition takes place above the white liquor addition so that the black liquor creates a barrier between the white liquor and the separator.

Figure 7:
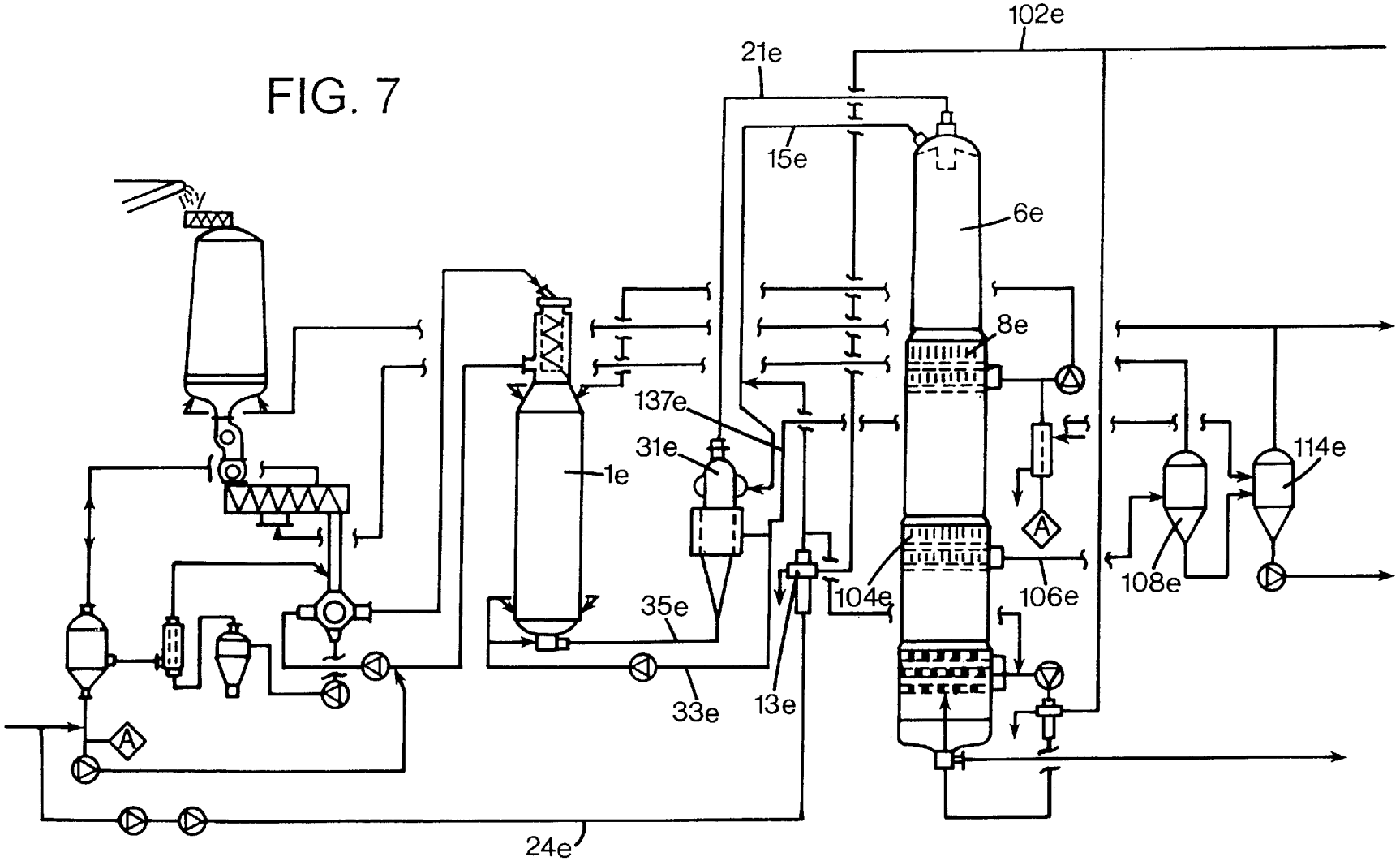
FIG. 7 is a schematic flow diagram of a preferred sixth embodiment of a digester system according to the present invention.

FIG. 7 describes a sixth embodiment of the present invention. In general, the sixth embodiment is very similar to the fifth embodiment shown in FIG. 6. The sixth embodiment has the advantage of including a liquid exchanger to completely eliminate the risk of any undesirable back flow of white liquor that is particularly difficult problem with most hydraulic digesters. However, the separator shown in FIG. 2 has features to reduce the risk of back flow.

A conduit 24*e* conducts white liquor to a return line 15*e*. The temperature of the white liquor may be controlled by a heat exchanger 13*e* that is adapted to receive steam from a high pressure steam conduit 102*e*. The temperature of the white liquor may be about 140–150° C. depending on the type of wood pulp that is used. The return line 15*e* terminates at a liquid exchanger 31*e*, which fulfills the same function as a top separator, i.e., it provides a very distinct exchange of treatment zones by almost totally withdrawing a first liquid from the chips and, subsequently, adding a second liquid so that any undesired mixing is avoided, the liquid changer 31*e*, in e. turn, has a mid-portion that is connected via a return line 33*e* to a bottom portion of an impregnation vessel 1*e*. A slurry of the chips and transport liquid may be conducted from the bottom portion of the impregnation vessel 1*e* via a conduit 35*e* to a bottom end of the liquid exchanger 31*e* after exchange of liquid the chips are transported in a conduit 21*e* to the top of a digester 6*e*. A portion of the spent liquor in the return line 33*e* is diverted and conducted to a second flash tank 114*e* via a conduit 137*e* for recovery.

Black liquor is withdrawn from a girdle section 8*e* of the digester 6*e* and conducted via a conduit 17*e* back to a top portion of the impregnation vessel 1*e*. Spent liquor is also drawn off from a screen girdle section 104*e* and is conducted to a first flash tank 108*e* via a conduit 106*e*.

Figure 8:
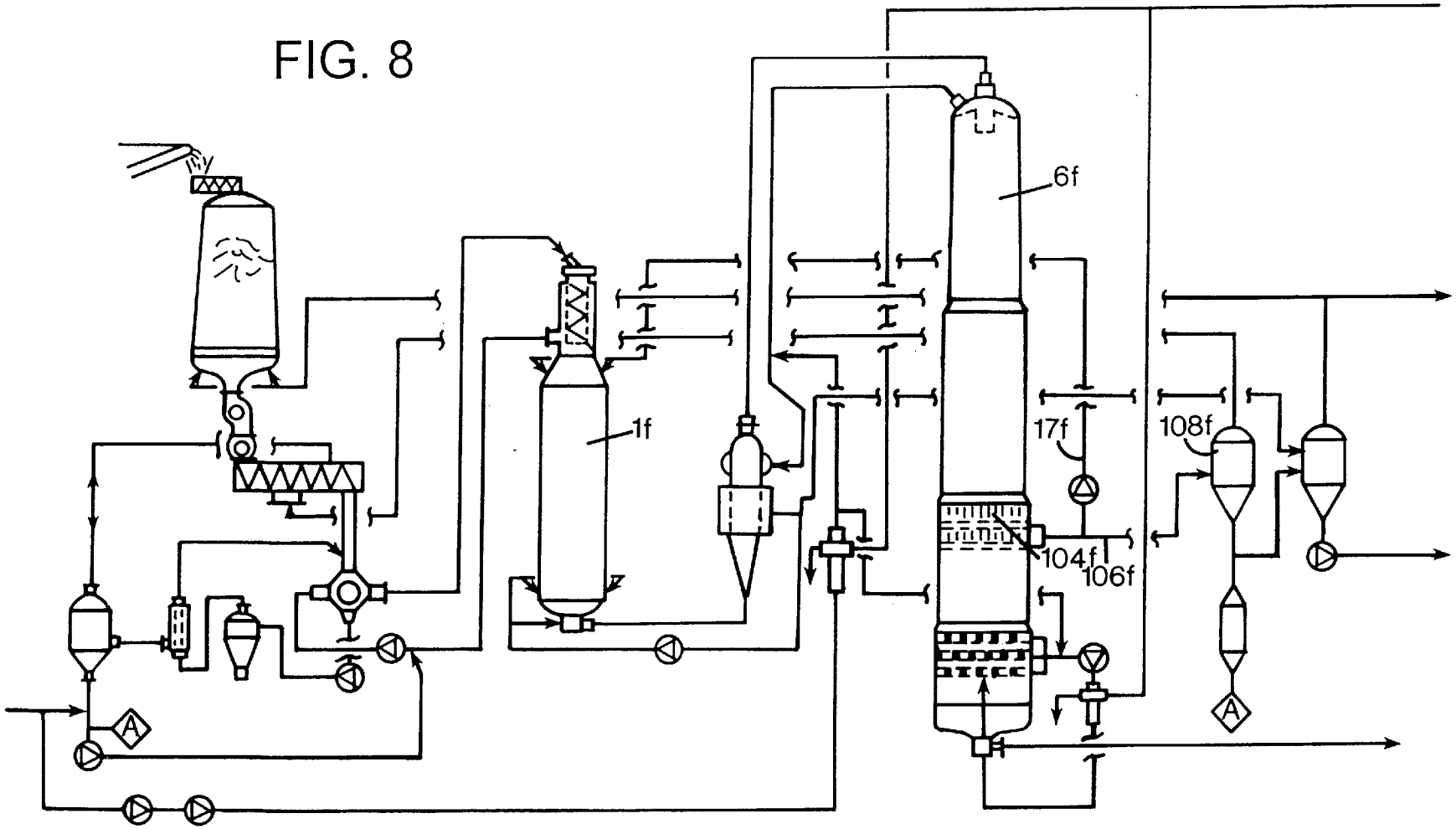
FIG. 8 is a schematic flow diagram of a preferred seventh embodiment of a digester system according to the present invention.

FIG. 8 shows a seventh embodiment of the present invention. This embodiment is similar to the sixth embodiment. In some instances, the seventh embodiment is preferred over the sixth embodiment because there is often no need for a screen between the top of the digester and the draw-off screen girdle 104. This is because the liquid exchanger and the transport to the digester often provide sufficient and homogenous mixing of the cooking liquor so that a perfect condition can be established in the long con-current cooking zone. If the conditions are optimally adjusted in the seventh embodiment, almost all or all the black liquor withdrawn from the screen 104 may be supplied to the impregnation vessel and therefore all or almost all of the liquid for the recovery may be taken from the liquid that is separated in the liquid exchanger.

Only some of the most important differences compared to the other embodiments are described. This embodiment has a digester 6*f* that does not have a screen girdle section at the top of the digester. Most of the spent liquor is therefore withdrawn from the digester 6*f* at a screen girdle section 104*f* and a portion of the spent liquor withdrawn is conducted via a conduit 17*f* back to an impregnation vessel 1*f*. The remaining portion of the spent liquor is conducted to a first flash tank 108*f* via a conduit 106*f*.

Figure 9:
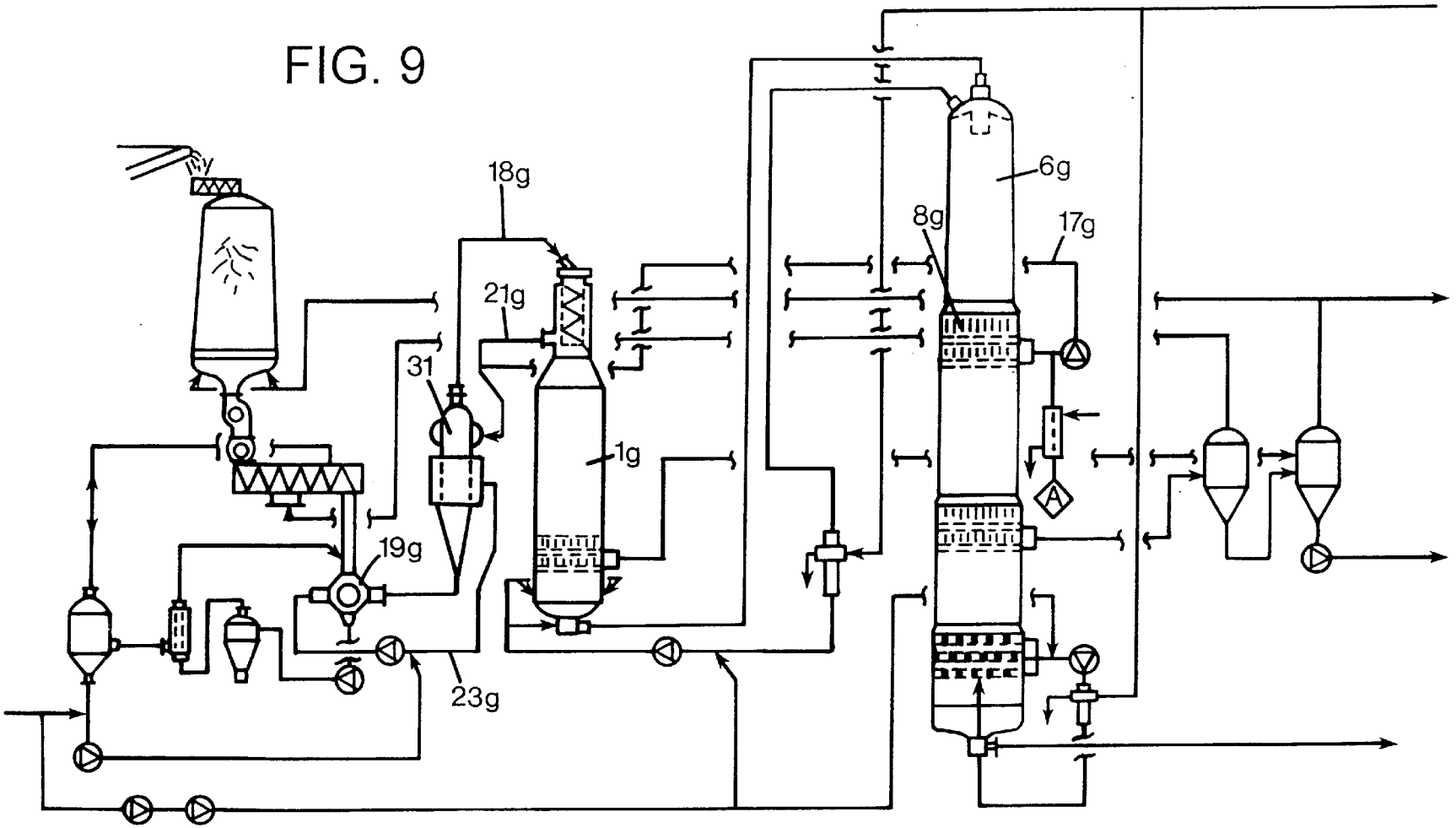
FIG. 9 is a schematic flow diagram of a preferred eighth embodiment of a digester system according to the present invention.

FIG. 9 illustrates a eighth embodiment of the present invention. This embodiment is similar to the embodiment shown in FIG. 7. Only some of the main differences are described. In general, when a liquid exchanger is used, there is no longer any need for a heat seal at the top of the impregnation vessel (contrary to the embodiments shown in FIGS. 6–8). In fact, even less expensive cupped gables can be used in the impregnation vessel. Therefore, the eighth embodiment may be an attractive way of retrofitting existing two vessel hydraulic digester systems. Also, the slurry of pulp and transport liquid is heated to a cooking temperature before the introduction into the digester by heating the transport liquid in the return line that is associated with a heat exchanger. It is to be understood that several advantages are gained by not only eliminating the heat seal in the impregnation vessel but also design the separator so that there is no back flow in the digester because a simple and inexpensive cupped gable design may be used at the top of both the impregnation vessel and the digester.

A high pressure feeder 19*g* feeds a slurry of chips to a bottom portion of a liquid exchanger 31*g*. The object of this liquid exchanger is to ensure safe operation of the high pressure feeder at the same time as a high temperature (e.g., 130° C.) is maintained at the top of an impregnation vessel 19, which is achieved by supplying hot black liquor to a conduit 21*g* via a conduit 17*g*. After exchange of liquid, the slurry is further conducted to a top of the impregnation vessel 19 via a conduit 18*g*. Relatively cool transport fluid is returned to the high pressure feeder 19*g* via a conduit 23*g*. The temperature of the transport liquid can be kept low thanks to the total exchange of free liquid.

Figure 10:
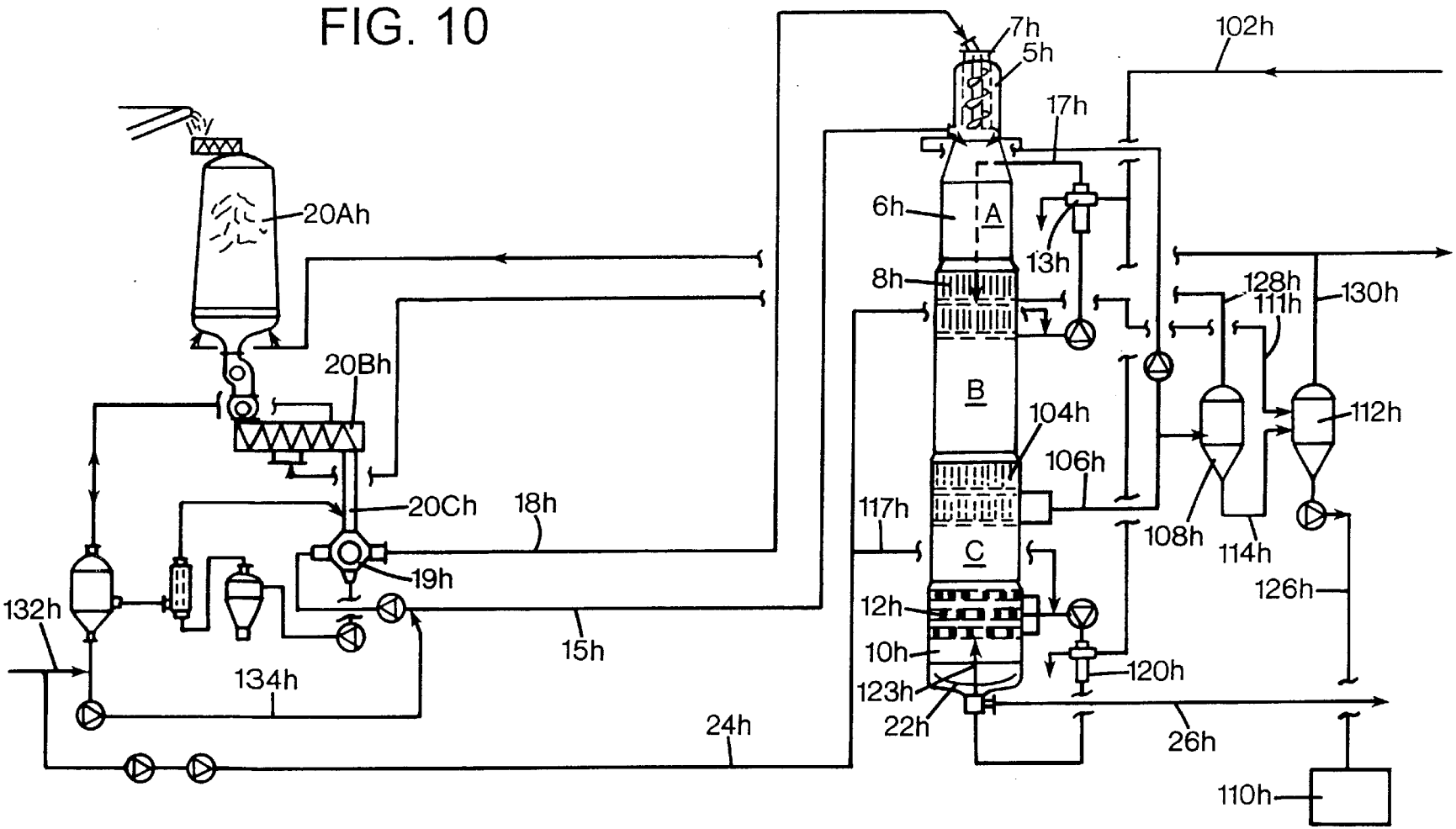
FIG. 10 is a schematic flow diagram of a preferred ninth embodiment of a digester system according to the present invention.

FIG. 10 illustrates a ninth embodiment of a single vessel hydraulic digester system of the present invention. The chips are fed from a chip bin 20Ah, through a steaming vessel 20Bh and a chip chute 20Ch. A feeding device, preferably a high-pressure feeder 19*h* feeds the chips suspended in a transport liquid D via a conduit 18*h* to the top of a digester 6*h*. The feeder 19*h* is cooperating with the chute 20Ch, and is connected to the necessary liquid circulations and replenishment.

The conduit 18*h* extends from the feeder 19*h* up to a top 5*h* of the digester 6*h*. The conduit 18*h* may open up at the top of a top separator 7*h* that feeds by means of a screw in a downwardly moving direction. The separator 7*h* is preferably identical or very similar to the top separator 7 that is shown in FIG. 2 and described in detail above. The screen of the separator may be used to draw off the transport liquid D (which is then returned in a return line 15*h*) together with which the chips are transported from the feeder 19*h* up to the top 5*h* of the digester 6*h*. A first screen girdle section 8*h* may be arranged in conjunction with a step-out approximately in the middle of the digester 6*h*. Draw-off of spent liquor from this screen girdle section 8 may be conducted via the conduit 17*h* to an impregnation zone A that is defined between the screen girdle section 8*h* and the top 5*h* of the digester 6*h*. A portion of the spent liquor may be withdrawn from the screen girdle section 8*h* via a conduit 111*h* that conducts the spent liquor to a second flash tank 112*h*.

A cooking liquor conduit 24*h* is operatively attached to the conduit 17*h* to supply a major part of the cooking liquor, such as white liquor, to the conduit 17*h*. A heat-exchanger 13*h* may heat up the white liquor and the spent liquor to a suitable temperature before the liquor enters the top 5*h*. The heat exchanger 13*h* may be in operative engagement with a high pressure steam line 102*h*. The effective alkali of the liquor in the conduit 17*h* is at least about 35 g/l; more preferably at least about 40 g/l; and, most preferably, between about 45 g/l and about 55 g/l.

Approximately 95% of the total supply of the white liquor in conducted in the conduit 24*h* and the remaining 5% is supplied to the high pressure feeder 19*h* via a conduit 132*h* and a conduit 134*h* to lubricate the high pressure feeder 19*h*.

A second screen girdle section 104*h* may be arranged below the first screen girdle section 8*h*. Draw-off from the second screen section 104*h*, such as spent liquor, i.e., black liquor, may be conducted via a conduit 106*h* back to a top portion of the impregnation zone A. The effective alkali of the spent liquor conducted in the conduit 106*h* is about 10–20 g/l. A portion of the black liquor in the conduit 106*h* may be conducted to a first flash tank 108*h* via a conduit 107*h* to cool the spent liquor before the liquor is conducted to a recovery unit 110*h*. Preferably, the spent liquor is also conducted through a second flash tank 112*h* via a conduit 114*h* to further reduce the temperature and pressure of the spent liquor before the liquor is conducted to the recovery unit 110*h*. The spent liquor from both flash tanks 108*h*, 112*h* are then conducted with a conduit 126*h* to the recovery unit 110*h*. Conduits 128*h* and 130*h* may be connected to the flash tanks 108*h*, 112*h*, respectively, to provide steam that is sent to the chip bin 20Ah and the steaming vessel 20Bh.

At a bottom 10*h* of the digester 6*h*, there is a feeding-out device including a scraping element 22*h*. A third lower screen girdle section 12*h* is disposed at the bottom 10*h* of the digester 6*h*. The girdle section 12*h* may, for example, include three rows of screens for withdrawing liquid, which is heated and to which some white liquor, preferably about 10% of the total amount of the white liquor in the conduit 24*h*, is added via a branch conduit 117*h* before it is recirculated by means of a central pipe 123*h*, which opens up at about the same level as the lowermost strainer girdle 12*h*.

The draw-off from screen girdles 12*h* and the white liquor from the branch conduit 117*h* are preferably conducted via a heat exchanger 120*h* back to the bottom 10*h* of the digester 6*h*. The high pressure steam conduit 102*h* is connected to the heat exchanger 120*h* to provide the heat exchanger 120*h* with steam to regulate the temperature of the white liquor in the conduit 116*h*. The temperature of this draw off is about 130–150° C. The temperature may depend on how much washing-liquor that has penetrated to the screen is withdrawn. The white liquor is supplied in a counter-current direction via the central pipe 123*h* to the screen girdle section 12*h*. The white liquor provides fresh alkali and, in the form of counter-current cooking, further reducing the kappa number. A blow line 26*h* may be connected to the bottom 10*h* of the digester for conducting the digested pulp away from the digester 6*h*.

A preferred installation according to the present invention, as shown in FIG. 10, may be described as follows. The chips are fed into the chip bin 20Ah and are subsequently steamed in the vessel 20Bh and, thereafter, conveyed into the chute 20Ch. The high-pressure feeder 19*h*, which is supplied with a minor amount of white liquor (approximately 5% of the total amount to lubricate the feeder), feeds the chips into the conduit 18*h* together with the transport liquid. The slurry of chips and the liquid are fed to the top of the digester 6*h* and may have a temperature up to 110–120° C. when entering the digester 6*h* (excluding recirculated transport liquor).

Inside the top of the digester 6*h*, there is the top separator 7*h* that pushes chips in a downward direction then the chips move slowly downwards in a plug flow through the impregnation zone A in a liquid/wood ratio between 2/1–10/1 preferably between 3/1–8/1, more preferred of about 4/1–6/1. Hot black liquor, which is drawn off from the screen girdle section 104*h*, may be added, via the conduit 106*h*, to the top of the impregnation zone A of the digester 6*h*. The black liquor may also be added to other sections of the digester such as to an intermediate section thereof. The high temperature of the black liquor (100–160° C.), preferably exceeding 130° C., more preferred between 130–160° C., ensures rapid heating of the chips flowing through the impregnation zone A. In addition, the relatively high pH, exceeding pH 10, of the black liquor neutralizes acidic groups in the wood and also any acidic condensate accompanying the chips, thereby, i.e., counteracting the formation of encrustation, so-called scaling.

An additional advantage of the method of the present invention is that the black liquor supplied into the impregnation zone A has a high content of rest alkali, (effective alkali EA as NaOH), at least 13 g/l, preferably about or above 16 g/l and more preferred between 13–30 g/l in the top of the impregnation zone A. This alkali mainly comes from the black liquor due to the high amount of alkali in the concurrent zone B of the digester 6*h*. Furthermore, the strength properties of the fibers are positively affected by the impregnation because of the high amount of sulphide. A major portion of the black liquor may directly (or via one flash tank) be fed into the impregnation zone A.

The total supply of black liquor to the impregnation zone A may exceed 80% of the amount drawn off from the draw-off screen girdle section 104*h*, preferably more than 90% and optimally about 100% of the total flow, which normally is about 8–12 $m^3$/ADT.

The retention time in the impregnation zone A should be at least 20 minutes, preferably at least 30 minutes and more preferred at least 40 minutes. However, a shorter retention time than 20 minutes, such as 15–20 minutes may also be used. The volume of the impregnation zone A may be larger than 1/11, preferably larger than 1/10 of the volume of the digester 6*h*. Additionally, in the preferred embodiment, the volume V of the impregnation zone A should exceed 5 times the value of the square of the maximum digester diameter, i.e., $V=5D^2$, where D is the maximum diameter of the digester 6*h*.

The chips, which have been thoroughly impregnated and partially delignified in the impregnation zone A, may be fed to the top of the digester 6*h* and conveyed into the downwardly-feeding top separator 7*h*. The chips are thus fed upwards through the screen, meanwhile free transport liquid may be withdrawn outwardly through the separator screen and finally the chips fall down into the digester 6*h*. Before or during their free fall, the chips pieces are drained with cooking liquor, such as white liquor, which is supplied at the top separator 7*h*.

The quantity of white liquor that is added at the top separator 7 depends on how much white liquor possibly is added else where. The thoroughly impregnated chips very rapidly assimilate the active cooking chemicals by diffusion, since the concentration of alkali (EA as NaOH) is relatively high, at least 20 g/l, preferably between 30 g/l and 50 g/l and more preferred about 40 g/l.

The chips then move down in the concurrent zone B through the digester 6*h* at a relatively low cooking temperature, i.e., between 130–160° C., preferably about 140–150° C. The major part of the delignification takes place in the first concurrent cooking zone B.

The liquid-wood ratio should be at least 2/1 and should be below 7/1, preferably in the range of 3/1–5.5/1, more preferred between 3.5/1 and 5/1. (The liquid wood-ratio in the counter-current cooking zone should be about the same as in the concurrent cooking zone.)

The temperature in the lower counter-current zone C is preferably higher than in the concurrent zone B, i.e., preferably exceeding 140° C., preferably about 145–165° C., in order to dissolve remaining lignin. The alkali content in the lowermost part of the counter-current cooking zone C should preferably be lower than in the beginning of the concurrent zone B, above 5 g/l, but below 40 g/l. Preferably less than 30 g/l and more preferred between 10–20 g/l. In the preferred case, the aim is to have a temperature difference of about 10° C. between the concurrent zone B and the counter-current cooking zone C. Expediently, the conduit 116*h* may be charged with about 5–20%, preferably 10–15%, white liquor from the conduit 24*h* via the conduit 117*h*.

The temperature of the liquid which is recirculated via the pipe 123*h* up to the screen girdle section 12*h* is regulated with the aid of the heat exchanger 120*h* so that the desired cooking temperature is obtained at the lowermost part of the counter-current cooking zone.

From tests made in lab-scale, we have found indications that it is desirable to keep the alkaline level at above at least 2 g/l, preferably above 4 g/l, in the impregnation zone A in connection with black liquor, which would normally correspond to a pH of about 11. If not, it appears that dissolved lignin precipitates and even condenses.

Figure 11:
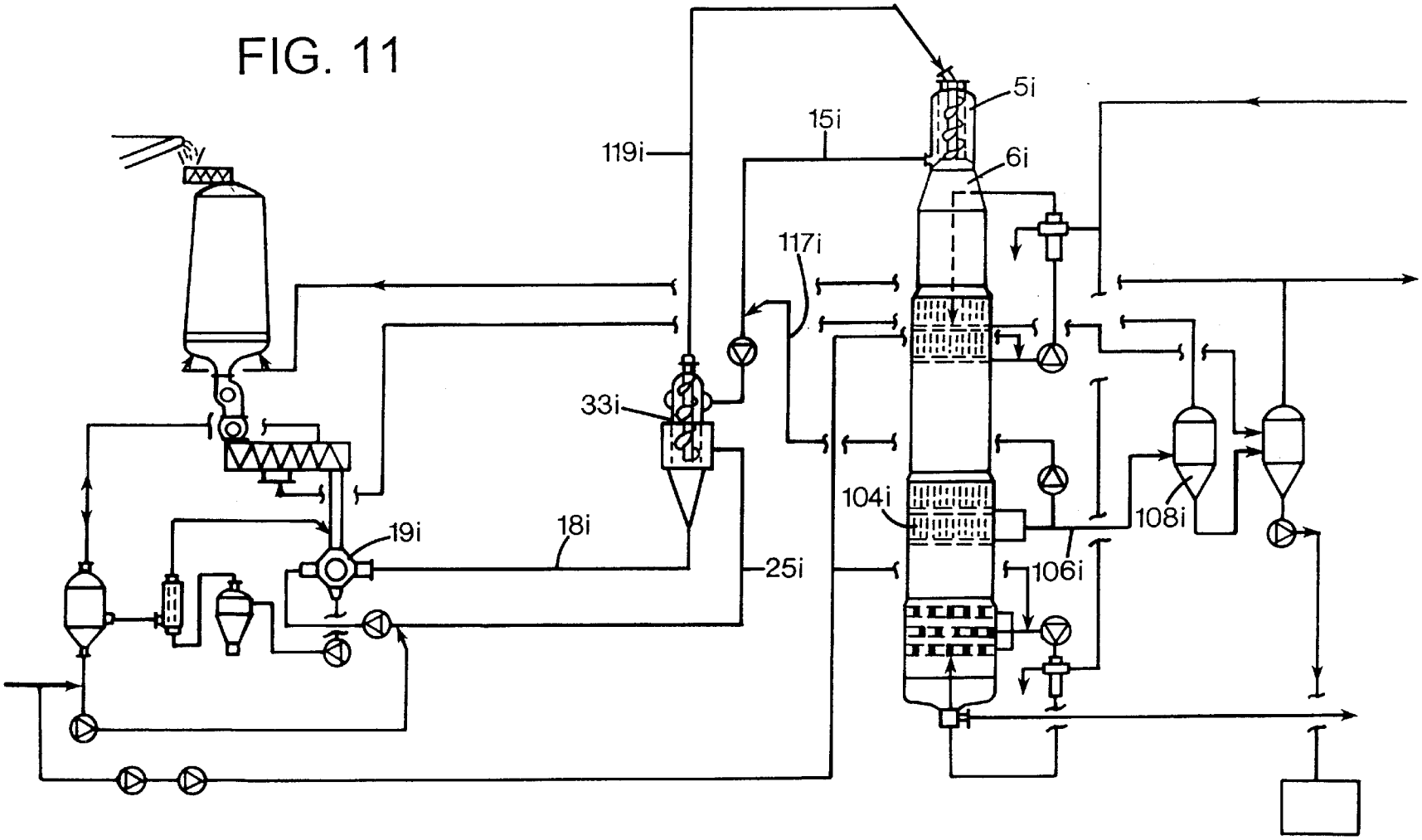
FIG. 11 is a schematic flow diagram of a preferred tenth embodiment of a digester system according to the present invention.

FIG. 11 illustrates a tenth embodiment of the present invention. This embodiment is substantially similar to the embodiment shown in FIG. 10. Chips and a transport fluid is pumped up in a conduit 18*i* and a conduit 119*i* to a top section 5*i* of a digester 6*i* via a liquid exchanger 33*i*. The operation of the liquid exchanger is similar to the liquid exchanger 33*i* described for the sixth embodiment shown in FIG. 7 and its function is similar to the eighth embodiment shown in FIG. 9. As described earlier, liquid is exchanged in the liquid exchanger 33*i* before the chips enter the top section 5*i* of the digester 6*i*.

A portion of the transport liquid may be returned in return line 15*i* that leads from the top portion 5*i* to a mid-section of the liquid exchanger 33*i* and then back to a feeder 19*i* via a conduit 25*i*. The conduit 106*i* conducts the spent liquor withdrawn from a screen girdle section 104*i* to the liquid from 117*i* and to the conduit 15*i*. A portion of the liquor in the conduit 106*i* may be sent to a flash tank 108*i*.

Figure 12:
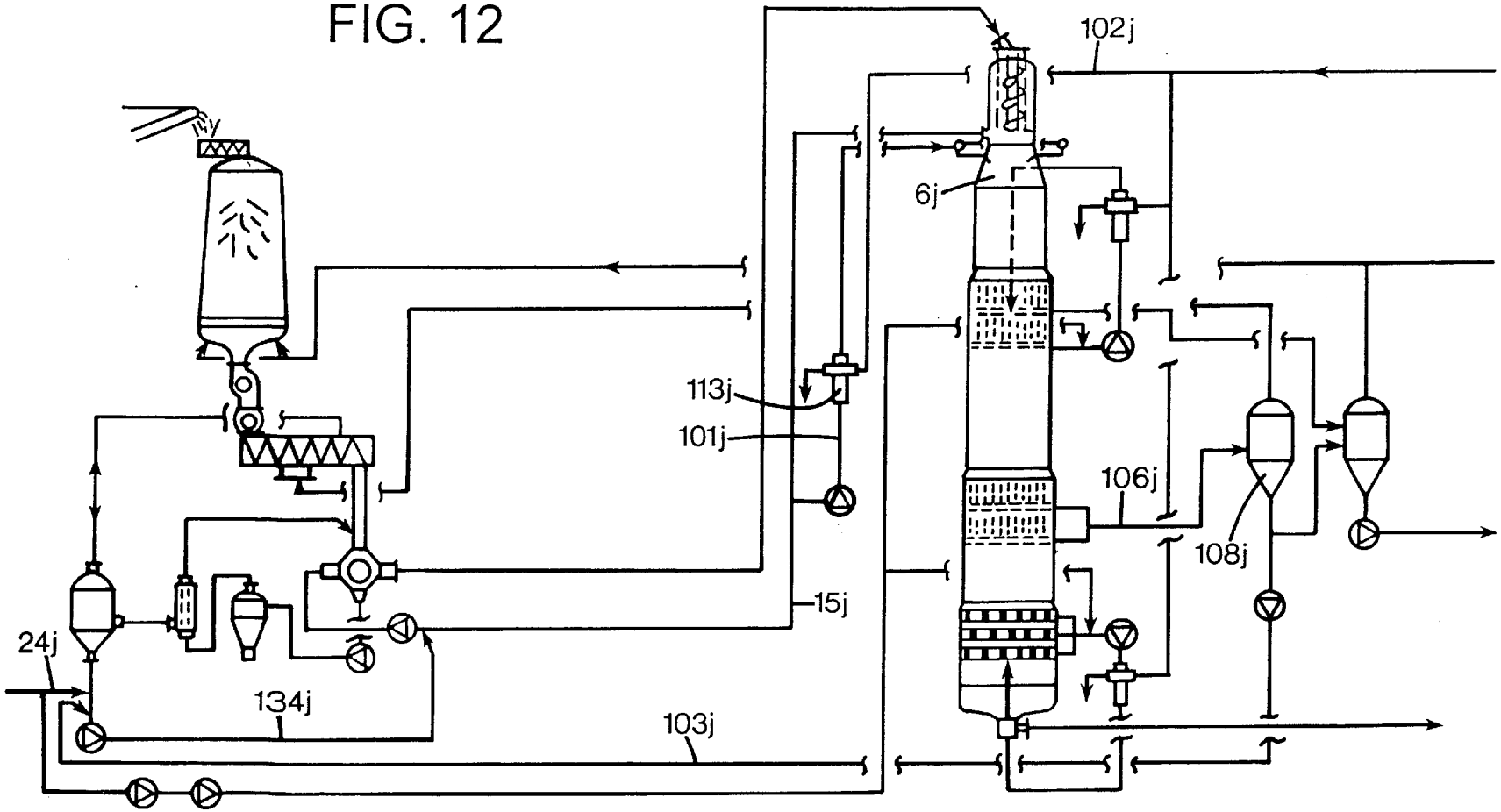
FIG. 12 is a schematic flow diagram of a preferred eleventh embodiment of a digester system according to the present invention.

FIG. 12 shows a eleventh embodiment of the present invention. The eleventh embodiment is similar to the ninth embodiment shown in FIG. 10. Some of the more important differences are described herein. The eleventh embodiment has a digester 6*j* having a return line 15*j* attached to a top portion 5*j* of the digester 6*j*. A recirculation line 101*j* is in fluid communication with the return line 15*j* so that a portion of the liquid in the return line 15*j* may he diverted back to the top portion 5*j* via the line 101*j*. The temperature of the liquid in the recirculation line 101*j* may be regulated with a heat exchanger 113*j* that is operatively engaged with a high pressure steam line 102*j*. The recirculation line is used to heat the liquid from the return line 15*j* before the liquid is introduced. The temperature in the return line 15*j* must not exceed about 100° C. to avoid undesirable flashing in the high pressure feeder.

Similar to the above described embodiments, a flash tank 108*j* is in fluid communication via a conduit 106*j* to a screen girdle section 104*j* so that spent liquor from the section 104*j* may be conducted to the flash tank 108*j*. A bottom portion of the flash tank 108*j* has a conduit 103*j* connected thereto to conduct a portion of the spent liquor back to a conduit 134*j* that carries some white liquor from the cooking liquor conduit 24*j*.

Figure 13:
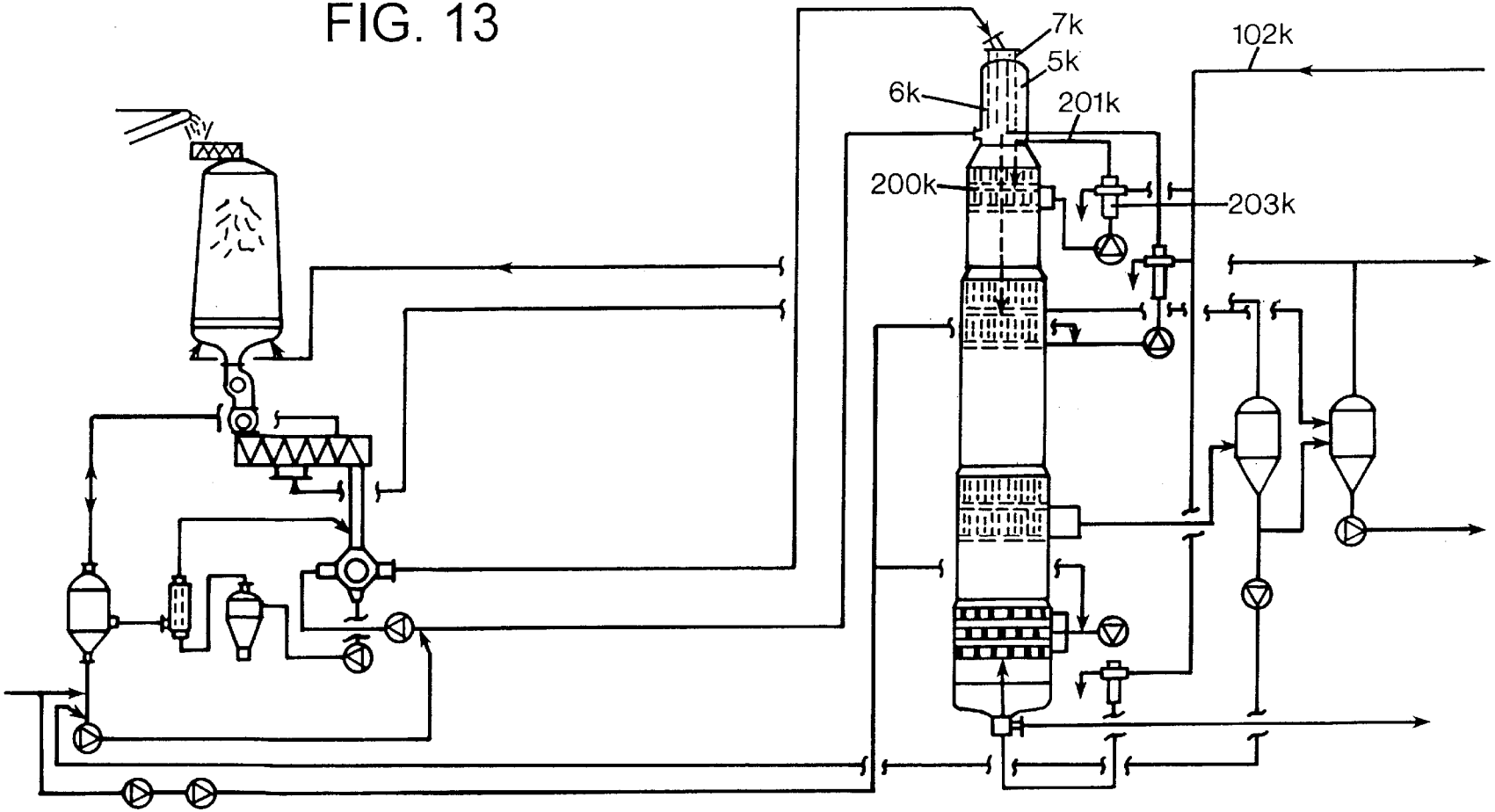
FIG. 13 is a schematic flow diagram of a preferred twelfth embodiment of a digester system according to the present invention.

FIG. 13 describes a twelfth embodiment of the present invention. This embodiment is similar to the embodiment shown in FIG. 12 but it does not have the recirculation line 101*j* that is associated with the return line. Instead the twelfth embodiment includes a digester 6*k* having an additional screen girdle section 200*k* that is disposed immediately below a top section 5*k*. The girdle section 200*k* has a recirculation line 201*k* in fluid communication therewith. The recirculation line 201*k* withdraws cooking liquor from the girdle section 200*k* and recirculates it back up to a point that is immediately below a top separator 7*k* disposed inside the top portion 5*k*. The temperature of the liquor in the line 201*k* may be controlled by a heat exchanger 203*k* that is in operative engagement with a high pressure steam line 102*k*. The main reason for using the recirculation line 201*k* is to improve the distribution of the white liquor that is withdrawn from the girdle section 200*k*. The method of recirculating the cooking liquor is often called quench circulation. The remaining sections of this twelfth embodiment are similar to the embodiments shown in FIGS. 10–12.

Figure 14:
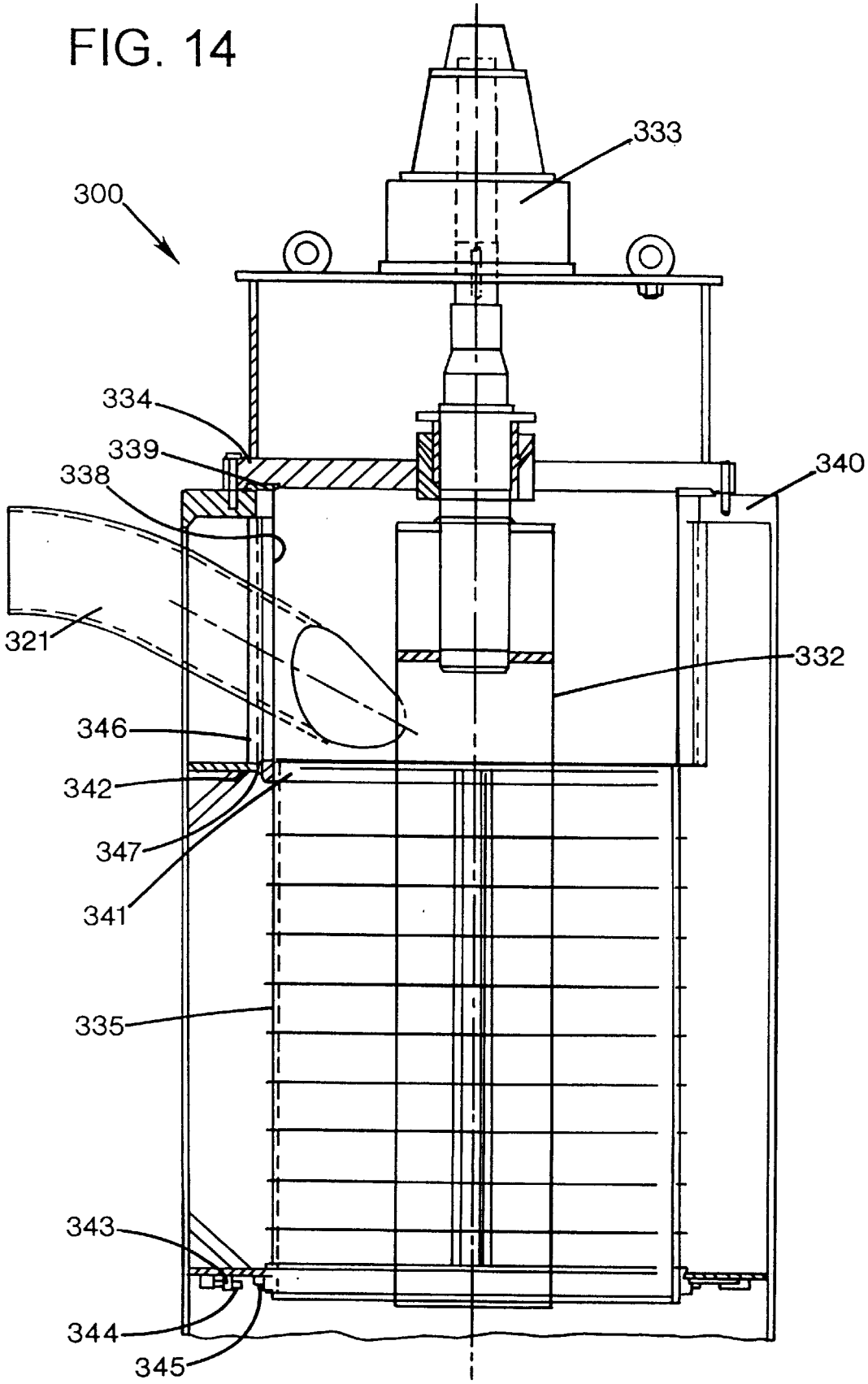
FIG. 14 is a cross-sectional view of a preferred third embodiment of a top separator of the present invention.

FIG. 14 is a cross-sectional view of a preferred third embodiment of a top separator 300 of the present invention. In contrast to previously downwardly feeding top separators, this third embodiment is peripherally supplied with chips/slurry. The top separator 300 has a rotating source 333 that is attached to a top of the top separator 300. The rotating source 333 may rotate a rotor 332 that is in operative engagement therewith and disposed inside the top separator 300. A plate or lid 334 is disposed adjacent the top of the top separator. The lid may be made of a suitable material such as a standard steel plate. The lid 334 extends diametrically across the top separator 300 and has a central opening defined therein to receive the rotor 332. A screen 335 is disposed below the lid 334 inside the top separator 300. The screen 335 extends vertically from about a mid-point of the top separator to a bottom portion of the top separator. The screen 335 is in operative engagement with the rotor 332. A supply conduit 321 for supplying chips into the top separator is disposed between the lid 334 and the screen 335. The supply conduit 321 extends through a side wall of the top separator. An important feature of this embodiment is that the supply conduit 321 does not extend through the lid 334 which makes the lid 334 expensive to manufacture such as by casting. Another important feature of this alternative embodiment that is solved by this embodiment is that it is often difficult to adjust, inspect and maintain the screen and the screw member because there is only a very limited space defined between the inner wall of the vessel and the screen. This makes is particularly difficult to adjust and center the screw member relative to the screen once the installation is completed.

A top of the screen 335 of the top separator 300 is integral with a cylindrical shell 338 that has a flange 339 resting on a support member 340 of the impregnation vessel. The screen 335 has a mid-segment collar 341 that is radially and tightly fitted within a supporting ring 342 at the top separator. This is to provide additional support of the screen 335 due to the large forces that are created at the top portion of the screen 335. A similar support device is disposed at a bottom portion of the screen 335. An adjustment mechanism 344 is attached to a support plate 343 at the bottom of the screen 335. The adjustment mechanism has an adjustment screw so that the position of the screen 335 relative to the wall of the top separator may be adjusted. In other words, the axial position of the bottom of the screen 335 may be adjusted with the adjustment mechanism 344. Similarly, a second adjustment mechanism 345 is in operative engagement with the bottom of the screen. It is an important advantage to be able to made the adjustment from below the screen 335. In fact, the adjustment can be made by standing on a platform within the vessel. The support plate 343 also ensures that the lower part of the screen 335 is lifted thanks to protruding pieces that bear against a sliding ring. Four U-beams 346 are disposed at the upper portion of the screen 335 to prevent the screen 335 from be rotated because the U-beams 346 are in operative engagement with a protruding segment 347 that is attached to the collar 341.

The invention is not limited to that which has been shown above but can be varied within the scope of the subsequent patent claims. Thus, instead of the shown separator used with the hydraulic digester many alternatives may be used, e.g., instead of an annular supply arrangement a central pipe (as shown in WO-9615313) for supply of liquid at distance downstream of the separator device within chip pile adjacent the top of the digester.

Moreover, there are many ways of optimizing the conditions even further, e.g., new on-line measuring systems (for example using NIR-spectroscopy) provide for the possibility of exactly measuring specific contents of the fiber material and the liquids entering the digesting system, which will make it feasible to more precisely determine and control the supply/addition of specific fluids/chemicals and also their withdrawal in order to establish optimized conditions. Different kind of additives can be very beneficial to use, especially for example poly-sulphide which has a better effect in a low temperature environment than in high temperatures. Also AQ (Anthraquinone) would be very beneficial since it combines very well with high alkaline environments.

Furthermore, there are a multiplicity of alternatives for uniformly drenching the chips with white liquor at the top of the digester. For example, a centrally arranged inlet (as described in WO 95/18261) having a spreading device can be contrived, which device, provides a mushroom-like film of liquid, as can a centrally arranged showering element or an annular pipe with slots, etc. In addition, the number of screen girdles shown is in no way limiting for the invention but, instead, the number can be varied in dependence on different requirements. The invention is in no way limited to a certain screen configuration and it is understood that bar screens can be exchanged by, for example, such as screens having slots cut out of sheet metal. Also in some installations moveable screens are preferred.

The shown system in front of the digester is in no way limiting to the invention, e.g., it is possible to exclude the steaming vessel 20 and have a direct connection between the chip bin (for example, a partly filled atmospheric vessel) and the chip chute. Furthermore, other kind of feeding systems than an high pressure feeder may be used, e.g., DISCFLO™-pumps).

While the present invention has been described in accordance with preferred compositions and embodiments, it is to be understood that certain substitutions and alterations may be made thereto without departing from the spirit and scope of the following claims.

We claim:

1. A method of treating a fiber material, comprising:

providing a treatment vessel having a cylindrical top section comprising a screw feeder and a heat lock zone, the treatment vessel having a liquid collection space defined between an outer shell of the treatment vessel and an outer surface of a screen basket surrounding the screw feeder, the treatment vessel having a liquid supply device disposed below the heat lock zone and a level sensor disposed below the screen basket but above the liquid supply device;

feeding a slurry of the fiber material and a transport liquid to the cylindrical top section;

feeding the slurry downwardly through the screen basket;

while feeding the slurry downwardly, separating the transport liquid from the fiber material;

while separating the transport fluid, withdrawing a substantial portion of the transport liquid into the liquid collection space so that only an insubstantial amount of free liquid remains in the screw feeder;

conducting the fiber material into a heat lock zone disposed below the screen basket but above the liquid supply device, the heat lock zone having a diameter (d) and a height (h), the height (h) being greater than the diameter (d);

the level sensor sensing a level of a liquid in the heat lock zone; and the heat lock zone preventing any substantial heat transfer from a larger diameter portion of the treatment vessel to the screen basket, the larger diameter portion having a diameter (D) being greater than the diameter (d) so that any heat transfer in an upward direction from the larger diameter portion into the screen basket is minimized due to a difference between the diameter (D) and the diameter (d).

2. A treatment vessel for fiber materials, comprising:

a feeding device for feeding a slurry of the fiber material and a transport liquid to a cylindrical top section of the treatment vessel;

a screw feeder disposed in the cylindrical top section of the treatment vessel, the cylindrical top section having a diameter (d);

a separator disposed in the cylindrical top section for separating a free liquor in the slurry with a screen basket surrounding the screw feeder, the screen basket having a liquid collecting space defined between a shell of the treatment vessel and an outer surface of the screen basket, the screen basket having a lower edge;

a conduit connected to the treatment vessel for withdrawing a liquid from the liquid collecting space;

a heat lock zone disposed in the treatment vessel, the heat lock zone comprising the fiber materials and the heat lock zone having a height (h) and the diameter (d) of the cylindrical top section, the height (h) being greater than the diameter (d) of the heat lock zone, the height (h) extending between the lower edge of the screen basket to a large diameter portion of the treatment vessel disposed below the cylindrical top section;

a liquid supply device disposed below the heat lock zone; and a level sensor disposed below the screen basket but above the liquid supply device to sense a liquid level in the treatment vessel.

3. The treatment vessel according to claim 2 wherein the treatment vessel is an impregnation vessel.

4. The treatment vessel according to claim 2 wherein the treatment vessel is a digester.

5. The treatment vessel according to claim 2 wherein the screw feeder is a downwardly feeding screw feeder.

6. The treatment vessel according to claim 2 wherein the treatment vessel further comprises a liquid supply device, disposed below the lower edge of the screen basket, for supplying a cooking liquor to the treatment vessel.

* * * * *